US008847489B2

(12) United States Patent
Teryaev et al.

(10) Patent No.: US 8,847,489 B2
(45) Date of Patent: Sep. 30, 2014

(54) LOW-VOLTAGE, MULTI-BEAM KLYSTRON

(75) Inventors: Vladimir Teryaev, Protvino (RU); Vyacheslav P. Yakovlev, Batavia, IL (US); Nikolay Solyak, Batavia, IL (US); Sergey Y. Kazakov, Batavia, IL (US)

(73) Assignee: Omega P-Inc., New Haven, CT (US)

( * ) Notice: Subject to any disclaimer, the term of this patent is extended or adjusted under 35 U.S.C. 154(b) by 360 days.

(21) Appl. No.: 12/908,739

(22) Filed: Oct. 20, 2010

(65) Prior Publication Data

US 2011/0089829 A1 Apr. 21, 2011

Related U.S. Application Data

(60) Provisional application No. 61/253,737, filed on Oct. 21, 2009, provisional application No. 61/394,623, filed on Oct. 19, 2010.

(51) Int. Cl.
*H01J 25/10* (2006.01)

(52) U.S. Cl.
CPC ..... *H01J 25/10* (2013.01)
USPC ..... 315/5.39; 315/5.41; 315/5.42; 313/446; 313/409; 313/414

(58) Field of Classification Search
USPC ..... 315/5.39, 500, 501, 509, 5.41, 5.42; 313/293, 299, 302, 383, 389, 409, 414, 313/446
See application file for complete search history.

(56) References Cited

U.S. PATENT DOCUMENTS

| | | | | |
|---|---|---|---|---|
| 3,558,967 | A * | 1/1971 | Miriam | 315/3.5 |
| 4,401,918 | A * | 8/1983 | Maschke | 315/5.34 |
| 6,147,447 | A * | 11/2000 | Beunas et al. | 315/5.43 |
| 6,847,168 | B1 * | 1/2005 | Ives et al. | 315/5.14 |
| 7,385,354 | B2 * | 6/2008 | Miyake | 315/5.39 |
| 7,446,478 | B2 * | 11/2008 | Syratchev | 315/5.39 |

* cited by examiner

*Primary Examiner* — Douglas W Owens
*Assistant Examiner* — Borna Alaeddini
(74) *Attorney, Agent, or Firm* — Arent Fox LLP

(57) ABSTRACT

A low-voltage, multi-beam, multi-MW RF source that operates at a voltage less than or equal to approximately 60 kV and generates at least one MW. The RF source includes a cathode configured to generate a plurality of beamlets. An input cavity and output cavity are common to the plurality of beamlets. A plurality of gain cavities are provided between the input and output cavities, each having a plurality of openings corresponding to the plurality of beamlets. The power source may further include a plurality of cathodes, each cathode generating a plurality of beamlets, wherein the input and output cavities are common to the plurality of beamlets from each of the plurality of cathodes, and a separate set of gain cavities are provided for each cathode. A single cathode version generates approximately 2.5 MW, and a four cathode version having four independent cavity systems and a common magnetic system generates approximately 10 MW.

5 Claims, 40 Drawing Sheets

Preliminart One-Dimensional Simulations and Optimizations
Results of ID DISCLI simulations Figure 7a
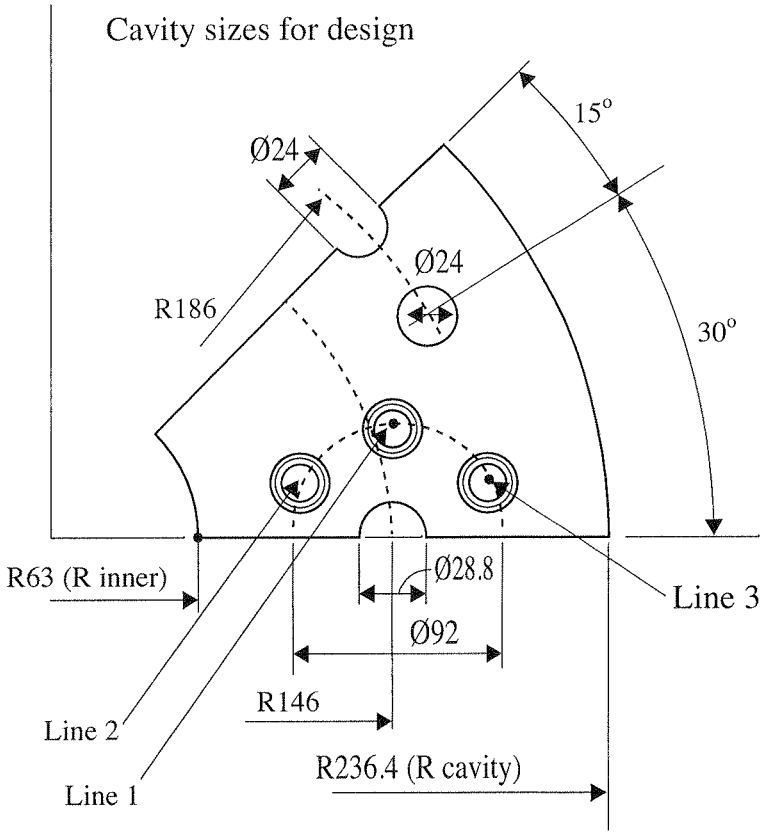
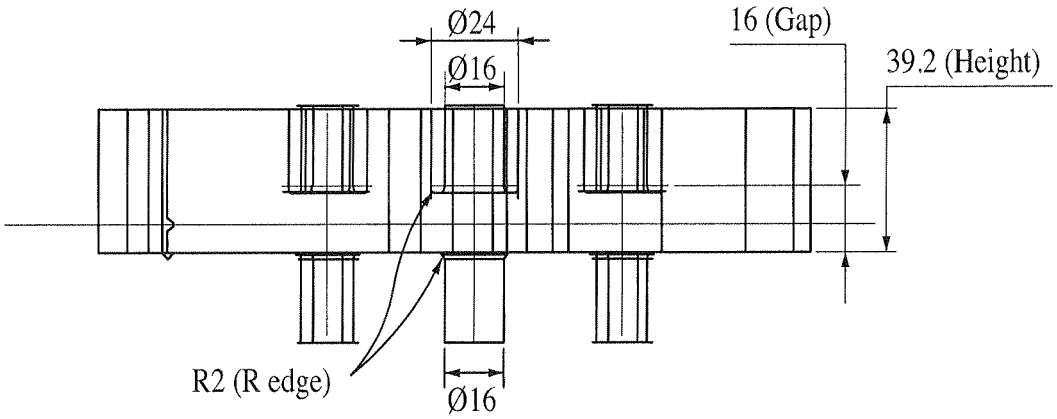
Figure 7b Electric Field Intensity $|E|_{XYSurface}$ in the surface $z = 0$ Magnetic Field $H_{XYSurface}$ in the surface $z = 0$ Electric Field in Gap Region Second Harmonic Cavity Penultimate Harmonic Cavity 1

Penultimate Harmonic Cavity 2

Magnetic System

Magnetic System

Output Section of the Magnetic System

Output Section of the Magnetic System

Variant of the Magnetic System

Table of Coordinate of Points from Gun-file is shown below.

| Point № | | R | Z | | Center of arc Rc | Zc |
|---|---|---|---|---|---|---|
| 1 | 1 | 0.0 | 10.0 | R | | |
| 2 | 1 | 14.0 | 13.467 | 1 | 0.0 | 40.0 |
| 3 | 1 | 16.5 | 16.5 | 0 | | |
| 4 | 1 | 16.5 | 18.0 | 0 | | |
| 5 | 1 | 20.5 | 22.0 | 1 | 20.5 | 18.0 |
| 6 | 1 | 24.0 | 22.0 | 0 | | |
| 7 | 1 | 36.0 | 10.0 | 1 | 24.0 | 10.0 |
| 8 | 1 | 36.0 | 1.0 | 0 | | |
| 9 | 0 | 50.0 | 1.0 | 0 | | |
| 10 | 2 | 50.0 | 36.5 | 0 | | |
| 11 | 2 | 14.0 | 36.5 | 0 | | |
| 12 | 2 | 12.0 | 38.5 | 1 | 14.0 | 38.5 |
| 13 | 2 | 12.0 | 110.0 | 0 | | |
| 14 | 2 | 8.0 | 120.0 | 0 | | |
| 15 | 2 | 8.0 | 300.0 | 0 | | |
| 16 | 2 | 0.0 | 300.0 | 0 | | |
| 17 | 0 | 0.0 | 10.0 | 0 | | |

Initial geometry, magnetic field is equal to 0
Result is shown in table below

| | | |
|---|---|---|
| Beam Current | 12.18 | A |
| Output Beam Radius | 3.88 | mm |

The size of a focusing electrode is increased. The result of simulation is shown in the table below.

| | | |
|---|---|---|
| Beam Current | 11.93 | A |
| Output Beam Radius | 3.75 | mm |

Gun Geometry for Design

LOW-VOLTAGE, MULTI-BEAM KLYSTRON

CLAIM OF PRIORITY UNDER 35 U.S.C. §119

The present Application for Patent claims priority to Provisional Application No. 61/253,737 entitled "LOW-VOLTAGE, MULTI-BEAM KLYSTRON" filed Oct. 21, 2009, and Provisional Application No. 61/394,623 entitled "LOW-VOLTAGE, MULTI-BEAM POWER SOURCE" filed Oct. 19, 2010, the entire contents of both of which are hereby expressly incorporated by reference herein.

BACKGROUND

1. Field

Aspects described herein relate generally to a low-voltage, multi-beam, multi-megawatt (MW) Radio Frequency (RF) source for accelerators.

2. Background

Aspects described herein relate generally to a low-voltage, multi-beam RF source/amplifier for accelerators, e.g. a low-voltage Multi-Beam Klystron (MBK).

RF sources can be used to power accelerators, such as ILC-type SRF accelerator structures at an acceleration gradient up to 35 MeV/m. This type of acceleration structure is planned for use in the ILC main linear accelerators (linacs), which is described in more detail in "ILC Reference Design Report, August 2007, ILC Global Design Effort and World Wide Study," a copy of which can be found at the Linear Collider Collaboration Website, and the entire contents of which are incorporated herein by reference.

Such RF source have other potential applications, such as in the high-energy portion of the proton linac for Project-X that is under development at Fermi National Accelerator Laboratory (FNAL), which is described in more detail in G. Appolinary, "ProjectX Linac, a copy of which can be found at the Project X. website, and the entire contents of which are incorporated herein by reference.

In ILC as well as in Project-X, the main lilacs would be constructed from one-meter long, nine-cell superconducting cavities operating at 1.3 GHz, Groups of 8-to-9 such cavities would be installed in a common cryostat, e.g. as described in S. Nagaitsev, "High Energy Linac Overview," Nov. 12, 2007, a copy of which can be found at the Project X website, and, the entire contents of which are incorporated herein by reference.

The accelerating gradients are to be about 25 MeVim (Project-X) and 31.5 MeV/m (ILC), The RF-power would be generated by klystrons, each feeding nine-cell cavities. The required peak power per klystron is 10 MW, including a 10% overhead for correcting phase errors during the beam pulse which arise from Lorentz force detuning and microphonics The RF pulse length is 1.5 ms, which includes the beam pulse length of ~1000 μs, and the cavity fill time of about 500 μs. The repetition rate is 5-10 Hz. Multiple versions of 10 MW MBK's have so far been designed and built as RF sources. Each includes an efficiency of around 60-65%. However, each of these tubes require a beam voltage of 117 kV, and thus one must employ a pulse modulator, pulse transformer, oil tank, high-voltage cables, and all the exceptional safety and maintenance provisions that accompany a high-voltage installation. Such high-voltage MBKs are described in A. Beunas, G. Faillon and S. Choroba, "A High Power Long Pulse High Efficiency Multi-Beam Klystron," a copy of which can be found at the Fermilab website, A. Balkoum, H. P. Bohlen, M. Cattelino, L. Cox, M. Cusick, S. Forrest, F. Friedlander, A. Staprans, E. L. Wright, L. Zitelli, K. Eppley, "Design and Operation of a High Power L-Band Multiple Beam Klystron, "*Proceedings of a* 2005 *Particle Accelerator Conference*, Knoxville, 2005, p. 2170, and Y. H. Chin, S. Choroba, M. Y. Miyake, Y. Yano, "Development of Toshiba L-Band Multi-Beam Klystron for European XFEL Project," *Proceedings of* 2005 *Particle Accelerator Conference*, Knoxville, 2005, p. 3163, the entire contents of each of which are incorporated herein by reference.

Thus, there is a need in the art for an RF amplifier with similar output parameters, but operating with a lower beam voltage.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

In view of the above described problems and unmet needs, a number of benefits result from aspects of a low-voltage, 10-MW, 1.3-GHz MBK, as described herein, namely (1) no pulse transformer would be required, (2) no oil tank would be required for high-voltage components and for the tube socket, (3) the modulator would be a compact 60-kV IGBT switching circuit built directly on the klystron, (4) high-voltage cables would not be required, and so forth.

Elimination of the pulse transformer could save perhaps 25% of the cost of the modulator, and would eliminate need to accommodate its 1-$m^3$ bulk and attendant weight that would make replacement a highly daunting task. Elimination of the large tank containing insulating oil for protection of the transformer and other high-voltage components would also reduce the bulk volume and weight of the installation, and reduce the complexity and fire hazard attending oil storage in a long confined tunnel. Finally, elimination of high-voltage cables connecting the modulator to the pulse transformer in the oil tank reduces the complexity and cost of the installation, and avoids complications that would attend their replacement. It is conceivable that elimination of these components could add further justification to a design for ILC that required only a single tunnel, rather than two; the savings in cost and complexity that this implies would be highly significant.

Aspects of such a low-voltage RF source may include an RF cavity chain, magnetic circuit, electron gun and beam collector for a low-voltage, 10-MW amplifier, such as around 1.3 GHz. Although a multiple cathode configuration may be used to generate higher amounts of MW, a single cathode may be used to generate at least 2 MW.

Aspects may further include a low-voltage, multi-beam, multi-MW RF source, having a low-voltage cathode configured to generate a plurality of beamlets; an input cavity common to the plurality of beamlets; an output cavity common to the plurality of beamlets; and a plurality of gain cavities provided between the input cavity and the output cavity, each having a plurality of openings corresponding to the plurality of beamlets, wherein the power source operates at a voltage less than or equal to approximately 60 kV and generates at least one MW.

The cathode may be configured to generate six beamlets. Aspects may further include a magnetic circuit configured to compensate for asymmetry experienced by the plurality of beamlets. A common magnetic circuit may be configured to compensate for asymmetry experienced by the beamlets. The magnetic circuit may include any of a pair of lenses, a solenoid, and an output coil configured to independently adjust a magnetic field in an output section. The solenoid and the output section may be separated by an iron plate. The magnetic circuit may include a plurality of compensating coils configured to compensate for transverse magnetic fields on an axis of each of the plurality of beamlets.

Aspects may further include a beam collector provided within the output section, wherein the beam collector includes a plurality of openings corresponding to each of the plurality of beam lets from the cathode.

A single cathode RF source may generate at least 2 MW.

Aspects may further include an RF source having a plurality of cathodes, each cathode being configured to generate a plurality of beam lets, wherein the input cavity is common to the plurality of beamlets from each of the plurality of cathodes, wherein the output cavity is common to the plurality of beamlets from each of the plurality of cathodes, and wherein a plurality of gain cavities are provided for each set of beamlets from a single cathode.

The RF source may include four cathodes, each cathode being configured to generate six beamlets. The RF source may generate more than 9 MW, e.g. 10 MW.

The RF source having a plurality of cathodes may further include a magnetic circuit configured to compensate for asymmetry experienced by the plurality of beamlets. This magnetic circuit may be common to each of the beamlets from the plurality of cathodes. The magnetic circuit may include any of a pair of lenses, a solenoid, and an output coil configured to independently adjust a magnetic field in an output section. The solenoid and the output section may be separated by an iron plate. The magnetic circuit may include a plurality of compensating coils configured to compensate for transverse magnetic fields on an axis of each of the plurality of beamlets.

The multi-cathode RF source may further include a beam collector provided in the output section, the beam collector being separated into a plurality of electrically independent sections, each section corresponding to one of the plurality of cathodes, wherein each section includes a plurality of openings corresponding to each of the plurality of beamlets from a single cathode.

The multi-cathode RF source may include four levels of gain cavities, each of the levels including a cavity corresponding to each of the cathodes.

The RF source may be configured such that a substantially symmetrical magnetic field is experienced by each of the plurality of beamlets at the input cavity and the output cavity.

Additional advantages and novel features of these aspects will be set forth in part in the description that follows, and in part will become more apparent to those skilled in the art upon examination of the following or upon learning by practice of the invention.

To the accomplishment of the foregoing and related ends, the one or more aspects comprise the features hereinafter fully described and particularly pointed out in the claims. The following description and the annexed drawings set forth in detail certain illustrative features of the one or more aspects. These features are indicative, however, of but a few of the various ways in which the principles of various aspects may be employed, and this description is intended to include all such aspects and their equivalents.

BRIEF DESCRIPTION OF THE DRAWINGS

The disclosed aspects will hereinafter be described in conjunction with the appended drawings, provided to illustrate and not to limit the disclosed aspects, wherein like designations denote like elements, and in which:

FIGS. 7*a* and 7*b* illustrate exemplary aspects of a cavity for an RF source.

DETAILED DESCRIPTION

Figure 1:
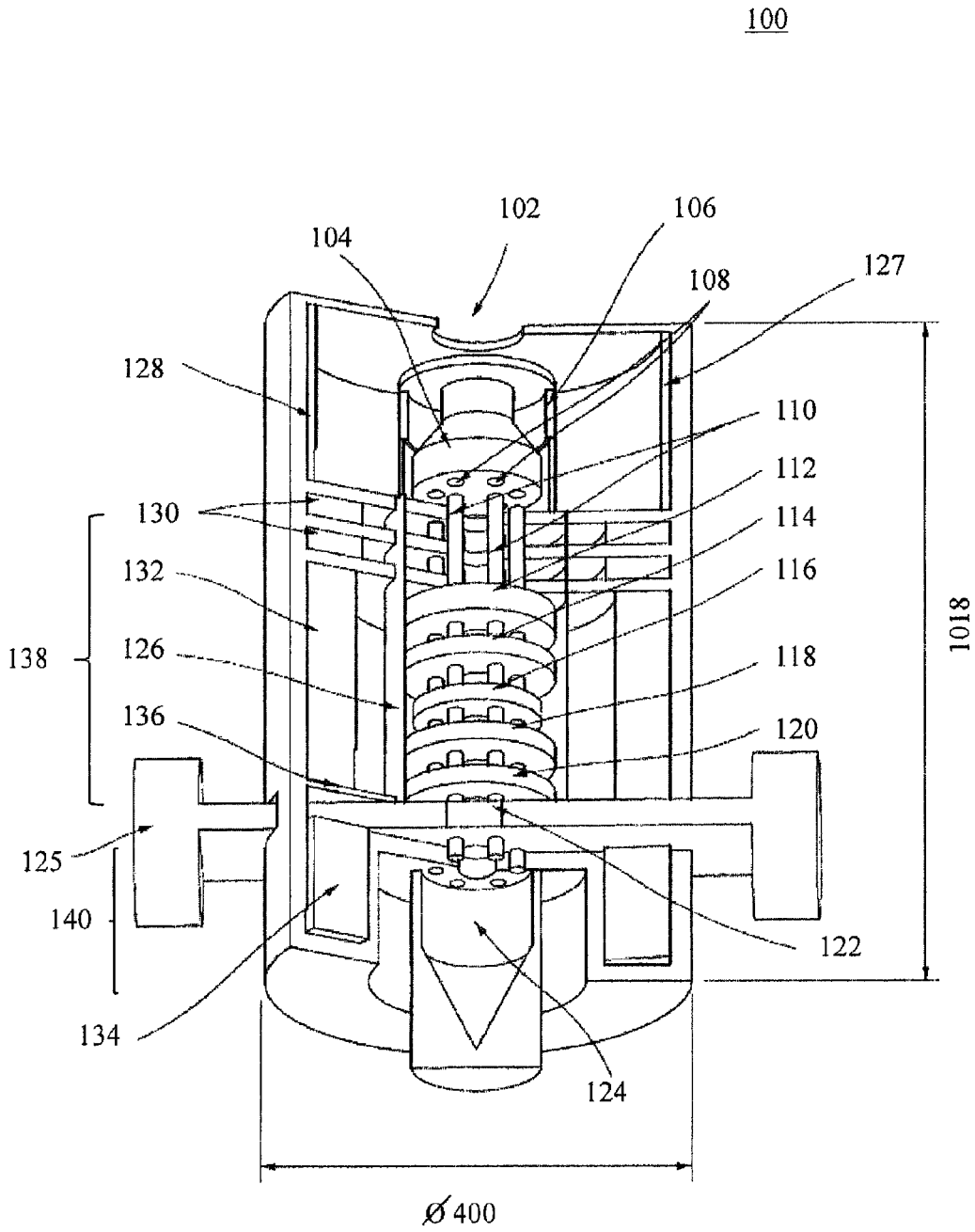
FIG. 1 illustrates exemplary aspects of a single cathode, low-voltage, multi-beam RF source.

Various aspects are now described with reference to the drawings. In the following description, for purposes of explanation, numerous specific details are set forth in order to provide a thorough understanding of one or more aspects. It may be evident, however, that such aspect(s) may be practiced without these specific details. These and other features and advantages are described in, or are apparent from, the following detailed description of various exemplary illustrations.

In order to achieve the above described benefits, aspects presented herein include a low-voltage, multi-beam, multi-MW RF source, having a low-voltage cathode configured to generate a plurality of beamlets; an input cavity common to the plurality of beamlets; an output cavity common to the plurality of beamlets; and a plurality of gain cavities provided between the input cavity and the output cavity, each having a plurality of openings corresponding to the plurality of beamlets, wherein the power source operates at a voltage less than or equal to approximately 60 kV and generates at least one MW. This may be a single cathode RF source that generates more than 2 MW, e.g. 2.5 MW, as well as a multi-cathode RF source that generates higher MW. For example, an exemplary implementation having a four cathode configuration may generate approximately 10 MW. Aspects may further include a magnetic circuit configured in common to the beamlets that compensates for asymmetry experienced by various beamlets.

The proposed MBK operates at a beam voltage <approximately 60 kV, a value that is determined by the desire to keep the individual beamlet perveance below $1\times10^{-6}$ $AV^{-3/2}$, and one implementation may have four cathodes assembled into a cluster with each cathode having six beamlets. Although it may be more costly, six clusters with six beam lets could be used and may provide a lower perveance than the four clusters. It is important to note that choice of a 60 kV voltage is consistent with use of available commercial capacitors in the modulator.

An exemplary multi-cathode tube may have the following main features. Twenty four beamlets may be combined from a cluster of four independent guns of six beamlets each. Four essentially separate guns with six cathodes may comprise the cluster. Four separate short collectors may be used, where each has a relatively low collector loading. Common input and output cavities may be used, each operating in the $TM_{210}$ quadrupole mode. intermediate gain cavities may operate in the fundamental $TM_{010}$ coaxial mode. A second harmonic bunching cavity can be used to increase efficiency and shorten the interaction region. A 2-coil matching lens system allows variable beam diameter and Brillouin parameter. A gun solenoid, with a uniform magnetic field in the gun region may be used. Compensation coils in the output section, with uniform magnetic field may be used.

A single 6-beamlet gun, one of the four cathodes, may also be provided and used separately. This makes it possible to test one-quarter of the full klystron before building the entire tube, in addition to providing a simplified RF source for other uses. For example, future applications (including ILC) may call for a low-voltage 2.5 MW L-band tube to power cavities in one cryomodule, thereby eliminating costly transmission waveguides and other components between a larger 10-MW klystron and four cryomodules. Other advantages of the aspects of the MBKs described herein include simple gun design that mitigates against hot dimension problems and avoids self-excitation. Low cathode current density implies long cathode lifetime. Low surface electric fields and identical electric field profiles in the beam-cavity interaction region are seen by each beamlet. Nearby higher-order mode competition issues are avoided by shifting the mode frequencies using shunts. Simplicity in the design enables easy cavity tuning.

It is widely recognized that future large accelerators are to be international projects, examples of which are the anticipated 0.5-1.0 TeV International Linear Collider ILC, and possibly a follow-on multi-TeV high-gradient collider such as CLIC—or perhaps even an alternative high-gradient design that might emerge from advanced tests at several laboratories world-wide. But a decision to proceed with any of these projects, no matter how compelling the physics case for their need, will ultimately rest with cost and complexity.

The low-voltage multi-beam cluster klystron described herein holds the potential to reduce both cost and complexity for ILC, the smaller FNAL Project X proton accelerator, and other accelerator projects. Cost savings can result for a lower voltage tube because of no need for high-voltage pulse transformers, large oil-filled high-voltage tanks, and high-voltage cables. Reduced hazard would also result by elimination of the large volumes of insulating oil needed for a higher-voltage installation. Moreover, the tube itself is expected to be less costly than existing high-voltage 10-MW L-band MBK's, because of its need for a smaller insulator and its inherent smaller size. Simplifications that can result include a compact IGBT switched modulator, smaller total footprint and height for the entire high-power RF system, and the possibility of a design for ILC requiring only one tunnel. The one-meter high tube described here could conceivably be mounted vertically in the tunnel, with the compact modulator mounted directly on the gun socket.

Aspects of the multi-cathode klystron described herein may include either a single cathode or a cluster of four cathodes containing six beams each. The tube may have common input and output cavities for all beams, and individual gain cavities for each cluster. A closely related optional configuration, also for a 10 MW tube, could include four totally independent cavity clusters with four independent input cavities and four 2.5 MW output ports, all within a common magnetic circuit. This option has appeal because the output waveguides would not require a controlled atmosphere, and because it would be easier to achieve phase and amplitude stability as required in individual SC accelerator cavities.

FIG. 1 illustrates aspects of an exemplary one cathode RF source having portions cut away. In FIG. 1, the single cathode klystron 100 includes an opening 102 for a high voltage input and an electron gun 104 including cathode ceramics 106 configured to generate a plurality of beamlets at beamlet cathodes 108. Beamlet drift tubes 110 connect between the beamlet cathodes and an input cavity 112. The input cavity 112 is provided in common to the beamlets the electron gun. A series of gain cavities, e.g. a gain cavity 114, a second harmonic cavity 116, a bunching cavity 118, and a penultimate cavity 120 are provided in line after the input cavity 112. Each of the cavities includes a plurality of openings, one opening for passing each of the beamlets. An output cavity 122 is provided common to each of the beamlets at the end of the group of gain cavities 114-120 opposite the input cavity 112. A beam collector 124 is provided adjacent the output cavity 124 having an output RF window 125, at the end of the klystron opposite the electron gun 104. A technological hole leads to the beam collector. The electron gun 104 and cavities 112-122 are surrounded by a klystron body 126, and a magnetic system 127. The magnetic system includes a gun solenoid 128, a pair of lens coils 130, a solenoid coil 132, and a coil 134 surrounding the output section. An iron plate 136 divides the cavity section 138 from the output section 140. The single cathode RF source in FIG. 1 generates at least one MW, e.g. approximately 2.5 MW.

Figure 2:
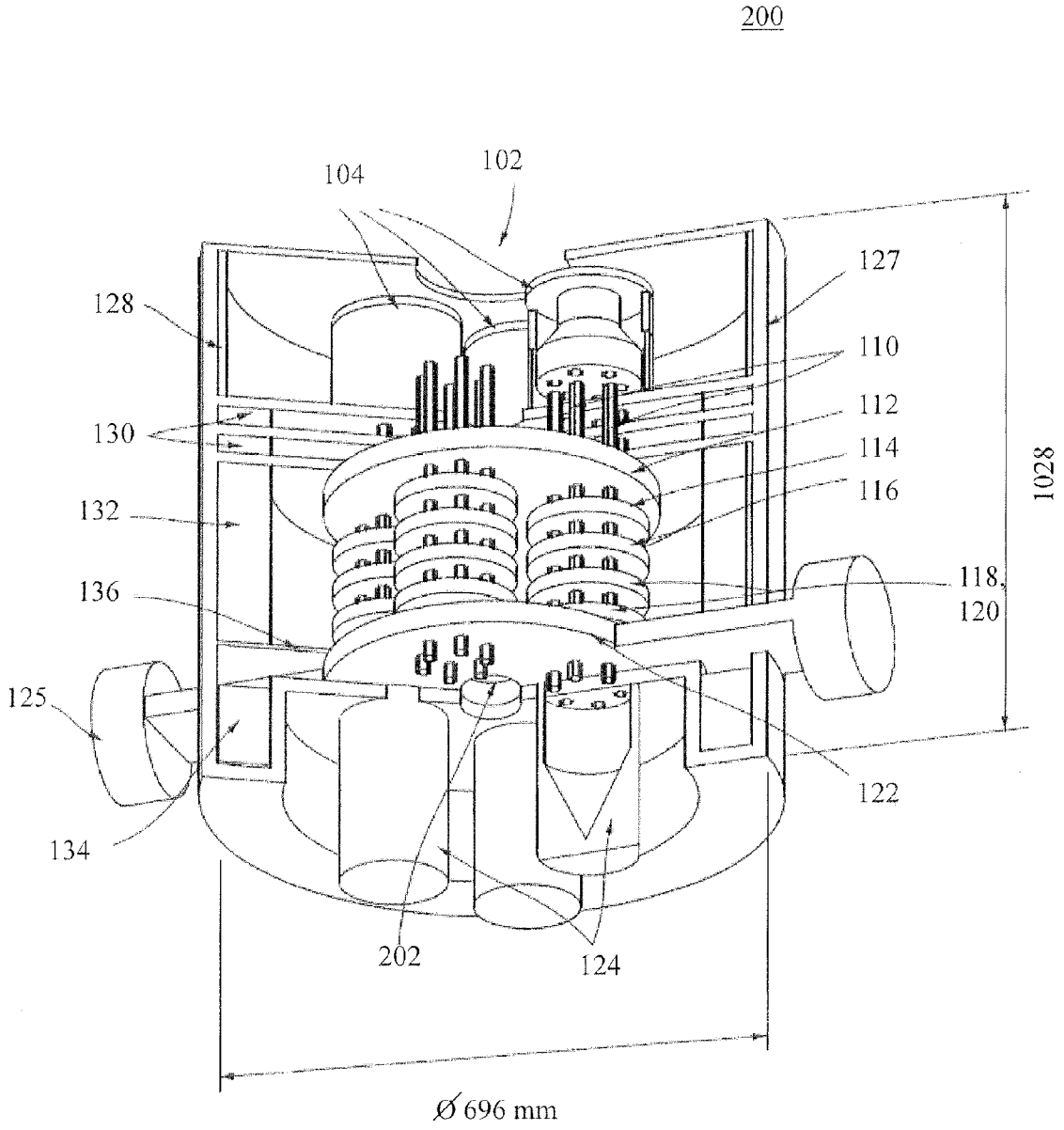
FIG. 2 illustrates exemplary aspects of a multi-cathode, low-voltage, multi-beam RF source.

FIG. 2 illustrates a cut-away view of a four cathode, 10 MW Klystron 200. Each quadrant of the 10 MW Klystron may be constructed and used independently. Similar elements are given the same reference number as in FIG. 1, and thus, will not be described in detail. The four cathode klystron 200 includes four cathodes 104. As with the single cathode configuration a common input cavity 122 and output cavity 122 are provided. However, a separate set of gain cavities, e.g. a gain cavity 114, second harmonic gain cavity 116, and first and second penultimate gain cavities 118 and 120, are provided separately for each of the cathodes in the cluster. An individual beam collector 124 is provided separately for each of the sets of beamlets from a single cathode in the cluster. A technological hole is provided 202 between the clusters of beamlets. The dimensions are shown in mm.

Parameters of one 2.5 MW quadrant, such as for the 2.5 MW Klystron in FIG. 1 are listed in Table 4. The four cathode power source includes four electron guns provided in a symmetrical configuration surrounding the opening for high voltage input. The input cavity and output cavity are common to each of the beamlets from each of the cathodes. The magnetic system is common to each of the beamlets from each of the cathodes. Each level of gain cavities includes a separate cavity for each of the cathodes. Thus, in this implementation, each level of gain cavity includes four sets of cavities, corresponding to each of the four cathodes. Similarly, four electrically independent beam collectors are provided in the output section.

Designing an MBK with given parameters may include having a general idea of an arrangement of beam-lets, cathodes, cavities, and cavity modes and then optimizing the geometry using three-dimensional codes (3D) for beam simulations. Designing may also include reducing the problem to two-dimensions (2D) by minimizing 3D effects and using 2D codes for beam dynamics simulations. In this approach, each beam-let is considered as a 2D entity in the gun, interaction region, solenoid, cavities, and beam collector. This approach can accelerate considerably the design process for the device. An estimation of the influence of 3D effects is needed, of course, but this can be made after a 2D design is at hand.

Beam-lets are incorporated into 4 groups of 6 beam-lets for each group (cluster). Input and output cavities are the common for all beam-lets. Intermediate cavities can be common for 6 beam-lets of every cluster. Optimization of beam dynamic has shown that for achievement of high efficiency and gain of 50 dB it is necessary, that each beam-let interact with 6 gaps of cavity. Thus the total number of cavities is equally to 4*4+2=18. Lengths of drift tubes and resonant frequencies of cavities can be optimized.

TABLE 1

| Exemplary 10 MW Klystron Data | |
|---|---|
| Operating Frequency | 1300 MHz |
| Beam Voltage | 60 kV |
| Number of Beam-lets | 24 |
| Beam-let Current | 12 A |
| Beam-let Micro Perveance | $0.816 \times 10^{-6}$ A-V$^{-3/2}$ |
| Total Beam Current | 288 A |
| Total Micro Perveance | 19.6 |
| Simulation Efficiency | 65.3% |
| Practical Efficiency | 60-63% |
| Output RF Power | 10.7 MW |
| Average Output RF Power | 150 kW |
| Pulse Duration | 1.5 ms |
| Saturated Gain | 50 dB |
| Saturated Input RF Power | 100 W |
| Solenoid Magnetic Field | 1000 Gs |
| Drift Tube Diameter | 16 mm |
| Beam Diameter | 10 mm |

TABLE 2

| Exemplary 10 MW Klystron Structure | |
|---|---|
| 4 Clusters of Cathodes having 6 beamlets | |
| Common Input Cavity | |
| Common Output Cavity | |
| 4 Levels of Interaction Cavities | (including 4 Second Harmonic Cavity "SHC") |
| Identical Cavities on each level | 4 |
| Total Number of Cavities | 18 |
| Number of Gun Units | 4 |
| Number of Collector Units | 4 |

TABLE 3

| Exemplary Output Cavity for 10 MW Klystron Structure | |
|---|---|
| Peak Surface Electric Field | 95 kV/cm |
| Nearest Lower Mode Frequency | 1226 MHz |
| Nearest Upper Mode Frequency | 1373 MHz |
| Nearest Mode Frequency to 2600 | 2297 MHz |
| Upstream Tube Diameter | 16 mm |
| Downstream Tube Diameter | 20 mm |
| Upstream Edge Radius | 4 mm |
| Downstream Edge Radius | 4 mm |

Figure 3:
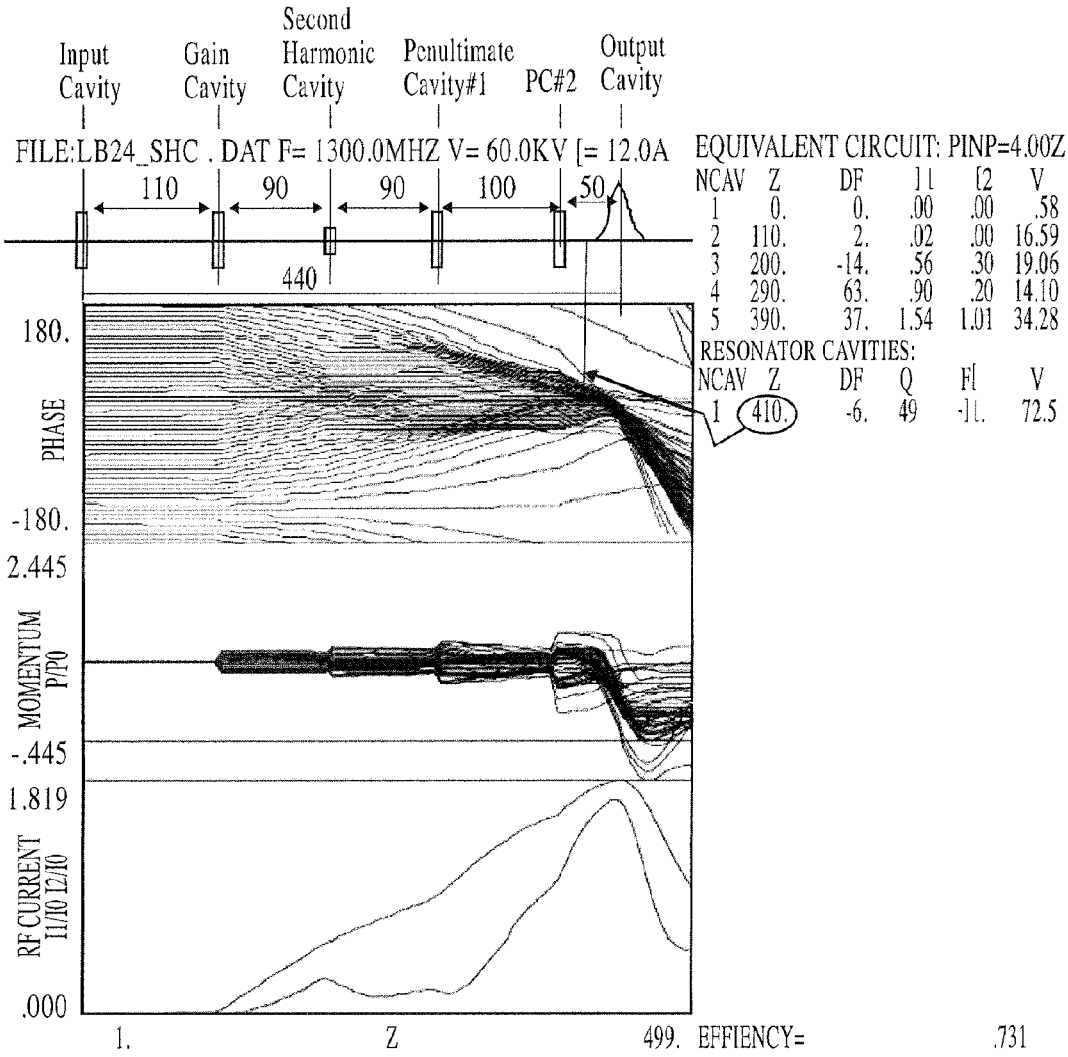
FIG. 3 illustrates exemplary aspects of a simulation of a low-voltage, multi-beam RF source.

An exemplary arrangement for the cavities layout may include 5 main harmonic cavities and one second-harmonic cavity (third one). FIG. 3 illustrates ID simulations fulfilled by DISCLY code. The distance between Penultimate Cavity and Output Cavity may be increased up to 80 mm. At smaller distances reflected electrons appear. Other layouts show presence of the reflected particles.

TABLE 4

| Exemplary 2.5 MW Klystron Data | |
|---|---|
| Operating Frequency | 1300 MHz |
| Beam Voltage | 60 kV |
| Number of Beam-lets | 6 |
| Beam-let Current | 12 A |
| Beam-let Micro Perveance | $0.816 \times 10^{-6}$ A-V$^{-3/2}$ |
| Total Beam Current | 72 A |
| Total Micro Perveance | 4.9 |
| Simulation Efficiency | 66.6% |
| Practical Efficiency | 62-63% |
| Output RF Power | 2.5 MW |
| Average Output RF Power | 40 kW |
| Pulse Duration | 1.5 ms |

TABLE 4-continued

| Exemplary 2.5 MW Klystron Data | |
|---|---|
| Saturated Gain | 50 dB |
| Saturated Input RF Power | 25 W |
| Solenoid Magnetic Field | 1000 Gs |
| Drift Tube Diameter | 16 mm |
| Beam Diameter | 10 mm |
| Peak Cathode Loading | 2.1 A/cm$^2$ |
| Peak of Electric Field on Focus Electrode | 65 kV/cm |
| Peak Surface Electric Field in Output Cavity | 95 kV/cm |

Figure 4:
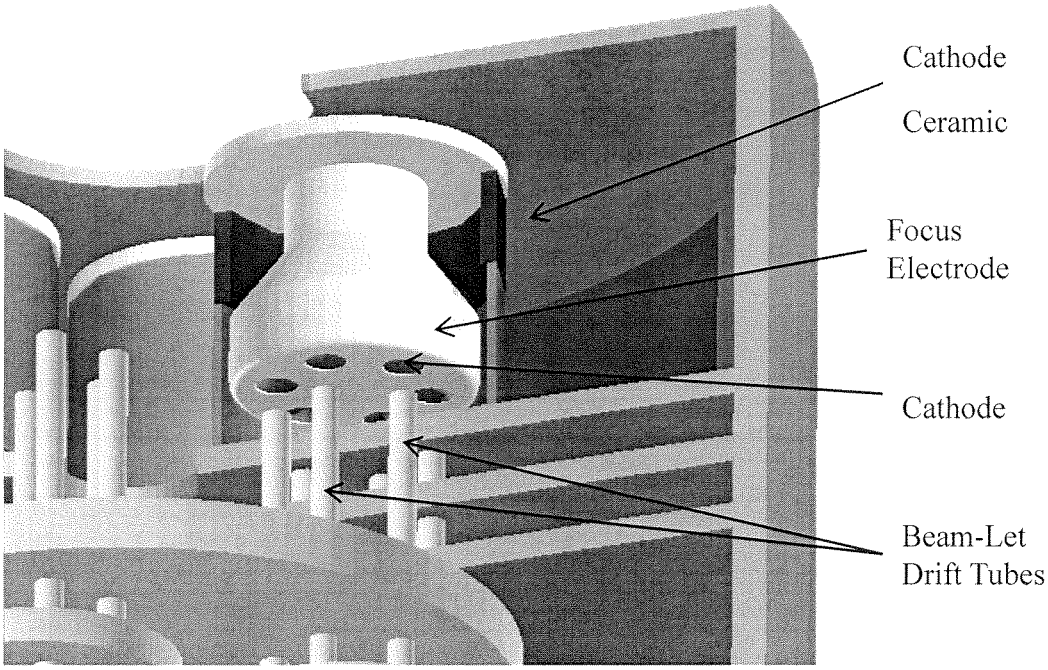
FIG. 4 illustrates exemplary a cut-away view of the RF source in FIG. 2.
Figure 5:
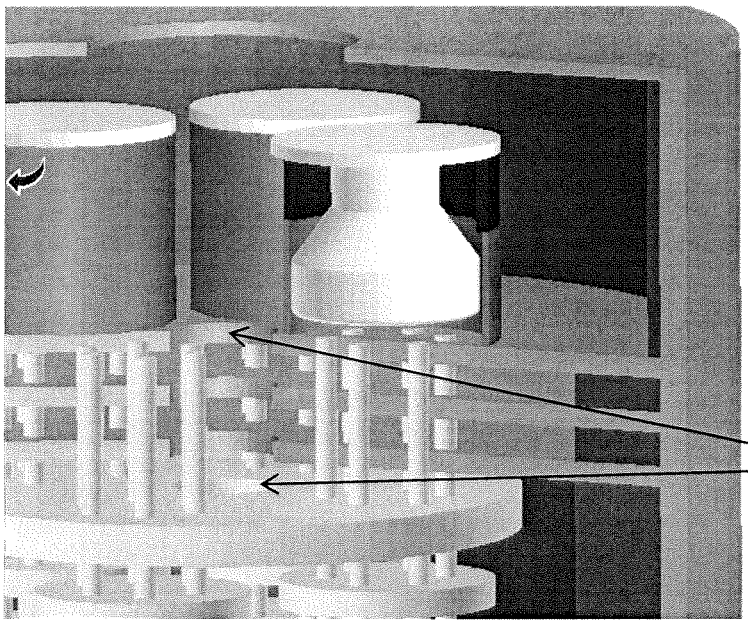
FIG. 5 illustrates exemplary aspects of a cut-away view of the RF source in FIG. 2.
Figure 6A:
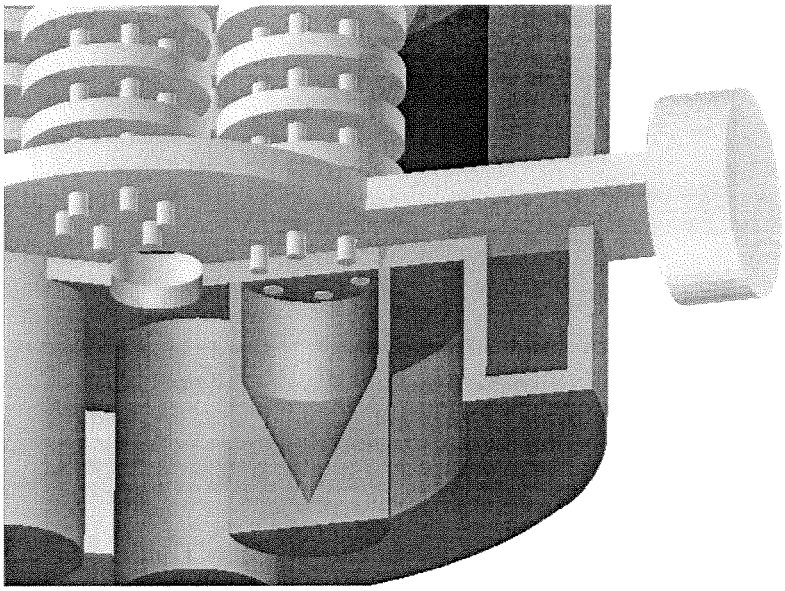
FIGS. 6*a* and 6*b* illustrate exemplary aspects of a cut-away view of the RF source in FIG. 2.
Figure 6B:
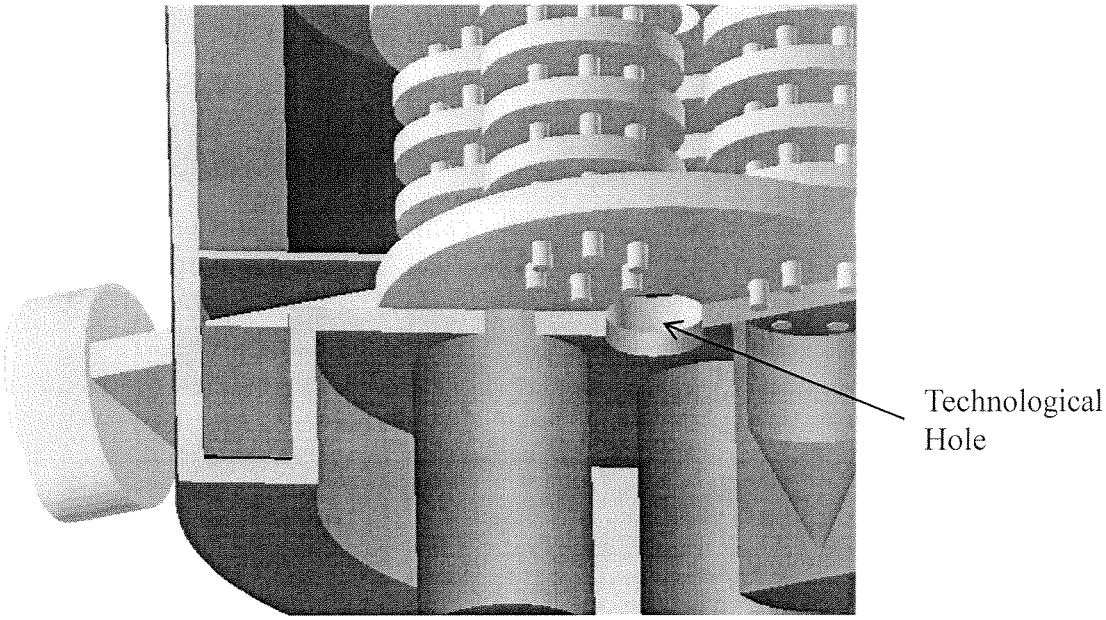

FIGS. 4 and 5 illustrate additional closer views of the layout of the gun region of the Klystron in FIG. 2. FIGS. 6*a* and 6*b* illustrate closer views of the layout of the output region for the Klystron illustrated in FIG. 2.

As described above, each quadrant of the 10 MW Klystron can be considered independently. By assembling a 2.5 MW cluster diode gun having six cathodes that produces 60 kV, 12.5 A electron beam-lets, enables an optimal design to be selected for the combined 10 MW RF system of the MBK. The 10 MW system may include an axial guide magnetic field of about 1 kG in order to provide good beam focusing and a lack of current interception that is essential for operating at high average power.

The drive and output cavity should be constructed so as to insure acceptable surface electric fields, good output efficiency, as well as the absence of parasitic self-excitation in all possible regimes of tube operation. The output cavity should be coupled into two WR-650 output waveguides.

Cavities

Cavities having separate drift tubes of similar shape may be used. These have not shown any problems connected with multipactor and beam instability. A configuration with separate drift tubes may be also provide a favorable spectrum of mode frequencies near to frequency of the second harmonic, 2,6 GHz. An output cavity having a small transient time angle provides higher impedance on this frequency and the amplitude of a field generated on this frequency can be dangerously high if the frequency of one of higher mode is close to the tube operating frequency harmonic 2.6 GHz.

It is noted that cavities having ring ledges may also be used, but such a configuration may increase manufacturing costs.

Two main parameters define the sizes of the input and output cavities: (1) the distance from the center to center of the cathodes, e.g. approximately 46 mm, and (2) the distance center to center of the clusters, e.g. 206.5 mm. These measurements set the radius of a circle on which guns are placed equal to 146 mm. In turn these sizes are defined by overall parameters of the gun (loading of the cathode, intensity of an electric field). Increase in size to more than 146 mm leads to a decrease of the distance of the neighboring parasitic mode to the operating frequency.

It may be beneficial to form each of the cavities with slightly differing outlines. An exemplary implementation of this is illustrated in the cavities shown in FIGS. 1 and 2. For example, the penultimate cavity PC#2 may have increased radii of rounding.

Neighboring Modes

Resonance frequencies of neighboring parasitic modes should be as far away from the frequency of the operating mode as possible. An increase in the gap between frequencies of the nearest higher and lower modes would mean an increase in electric coupling between regions of the cavity that is not possible in existing geometry. Tuning of the next modes is carried out by the inductive and capacitor elements placed in the cavity volume. In the exemplary implementation, this shifted frequencies of the nearest upper and lower modes by about 70 MHz. Modes of the cavity with frequencies close to high RF harmonics on the beam current may be dangerous as well. These require detuning also. The output circuit of the output cavity should load these modes so as to reduce their amplitude.

The input cavity dimensions and tolerances are shown in Table 5. The cavity layout and dimensions are shown in FIGS. 7*a* and 7*b*. (R/Q) calculated in all three channels (along Lines 1, 2 and 3, in FIGS. 7*a* and 7*b*) are close to each other demonstrating a good matching. In FIGS. 7*a* and 7*b*, the input cavity configuration and dimensions are illustrated in mm.

TABLE 5

| Exemplary Input Cavity Dimensions | |
|---|---|
| Operating Mode | TM 210 |
| Mode Frequency (with shown sizes) | 1301.6 MHz |
| Gap | 16 mm |
| Height | 39.2 mm |
| R cavity | 236.4 mm |
| R inner | 63 mm |
| R edge | 2 mm |
| Tube Diameter | 16 mm |
| R/Q Line1 | 138.2 Ohm |
| R/Q Line2 | 139.8 Ohm |
| R/Q Line3 | 142.6 Ohm |
| R/Q average | 140 Ohm (for 2D equivalent cavity) |
| Q (without coupler, ideal Cu) | 9120 |
| Q (with coupler) | 400 |
| Tolerance, dF/d(Gap) | 30.8 MHz/mm |
| Tolerance, dF/d(Height) | −19.1 MHz/mm |
| Tolerance, dF/d(R cavity) | −3.1 MHz/mm |
| Tolerance, dF/d(R inner) | 2.8 MHz/mm |

The parasitic mode spectrum is as follows, where mode frequencies are listed in MHz in Table 6.

TABLE 6

| Exemplary Parasitic Mode Spectrum in MHz | |
|---|---|
| Near to operating | Near to second harmonic |
| EE Boundary | |
| 1351 | 2183 |
| 1502 | 2942 |
| 1774 | 2973 |
| HE Boundary | |
| 1221 | 2115 |
| 1424 | 2157 |
| 1510 | 2031 |
| HH Boundary | |
| 1181 | 2067 |
| 1296 (operating mode) | 2926 |
| 1467 | 3003 |

Figure 8A:
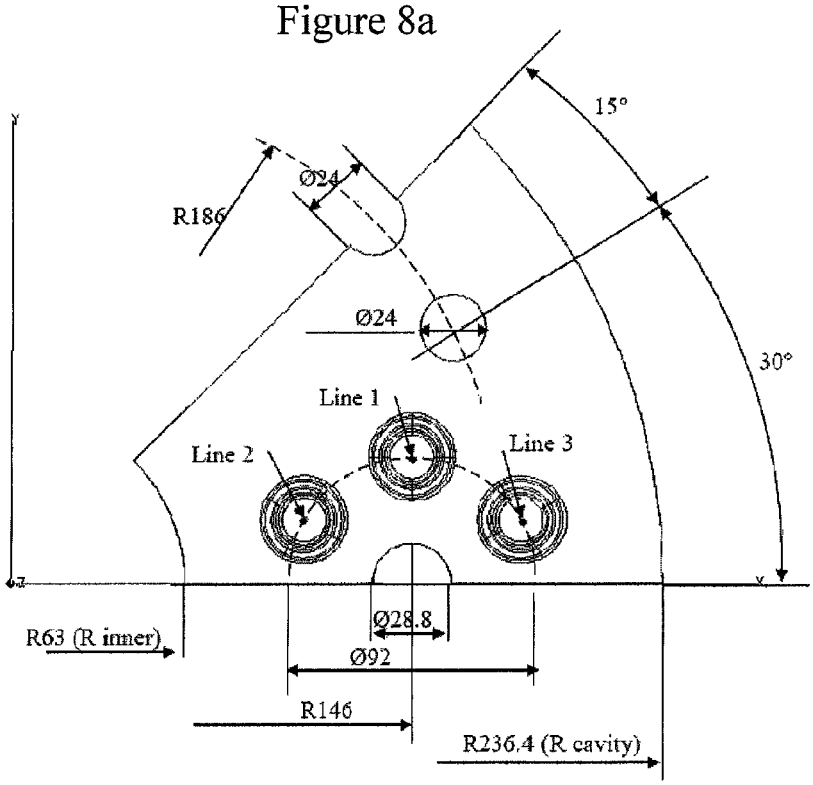
FIGS. 8*a* and 8*b* illustrate exemplary aspects of a cavity for an RF source.
Figure 8B:
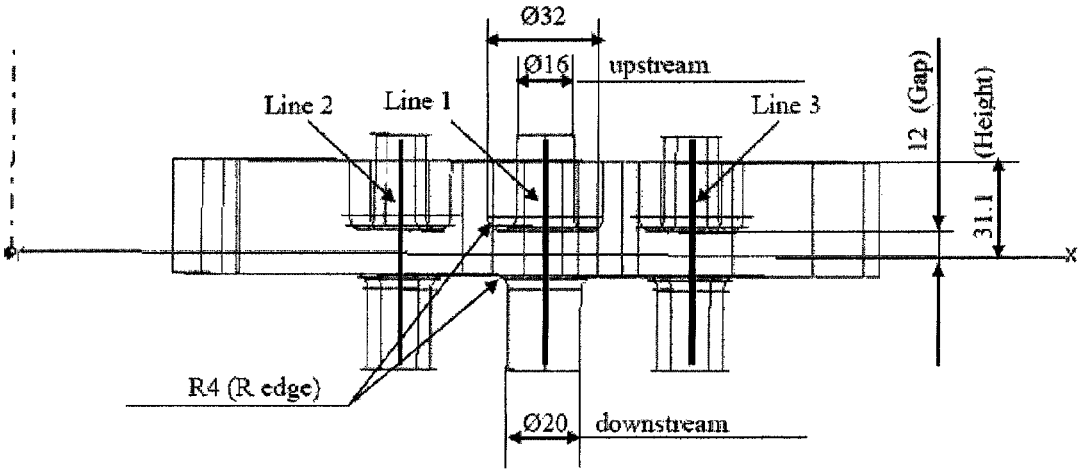

FIGS. 8*a* and 8*b* illustrate exemplary dimensions in mm for an output cavity. Exemplary parameters for the output cavity are shown in Table 7

TABLE 7

| Exemplary Parameters for an Output Cavity | |
|---|---|
| Operating Mode | TM 210 |
| Mode Frequency (with shown sizes) | 1301.4 MHz |
| Gap | 12 mm |
| Height | 31.1 mm |
| R cavity | 236.4 mm |

TABLE 7-continued

| Exemplary Parameters for an Output Cavity | |
|---|---|
| R inner | 63 mm |
| R edge | 4 mm |
| Tube Diameter (Upstream) | 16 mm |
| Tube Diameter (Downstream) | 20 mm |
| Q (without coupler, ideal Cu) | 7960 |
| Q (with WG coupler) | |
| R/Q Line 1 | 100.8 Ohm |
| R/Q Line 2 | 101.4 Ohm |
| R/Q Line 3 | 103.4 Ohm |
| R/Q Line average | 102 Ohm (for 2D equivalent cavity) |
| E surf max (V line = 60k) | 86 kV/cm (expected operating value) |
| Tolerance, dF/d(Gap) | 37.7 MHz/mm |
| Tolerance, dF/d(Height) | −21.9 MHz/mm |
| Tolerance, dF/d(R cavity) | −3.7 MHz/mm |
| Tolerance, dF/d(R inner) | 2.7 MHz/mm |

Figure 9A:
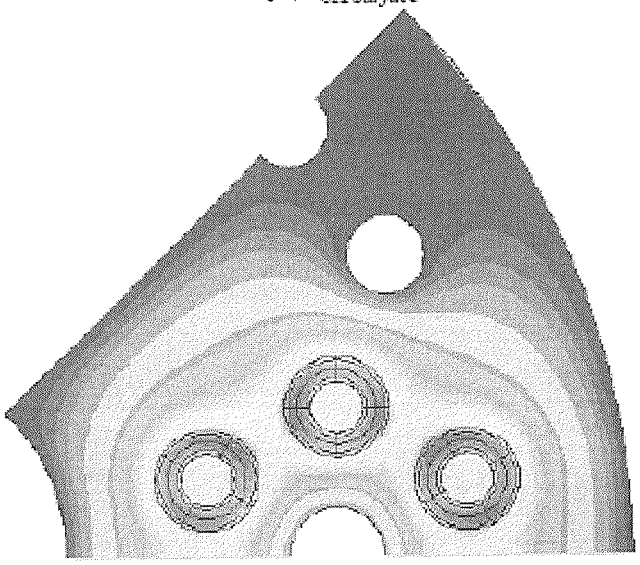
FIGS. 9*a* and 9*b* illustrate exemplary aspects of fields in an RF source.
Figure 9B:
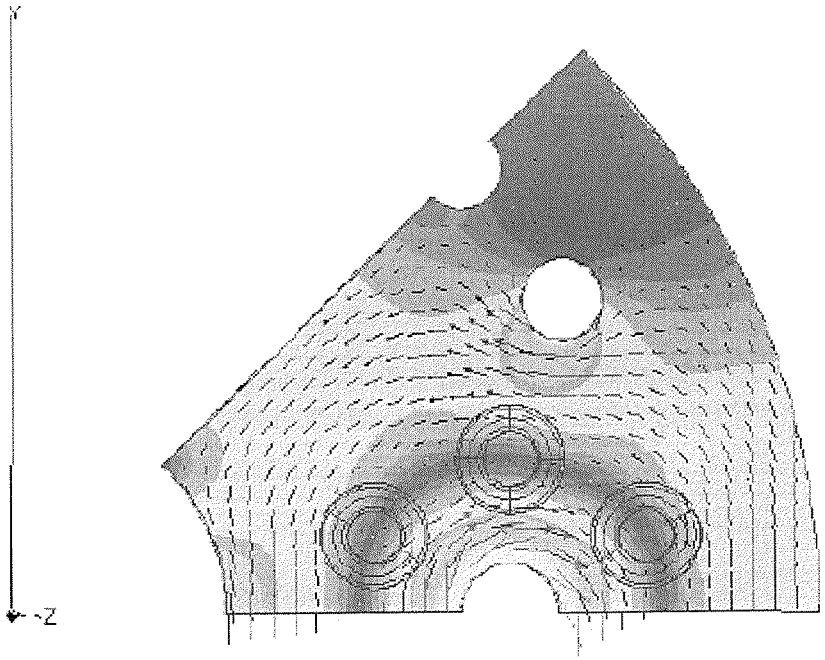
Figure 10A:
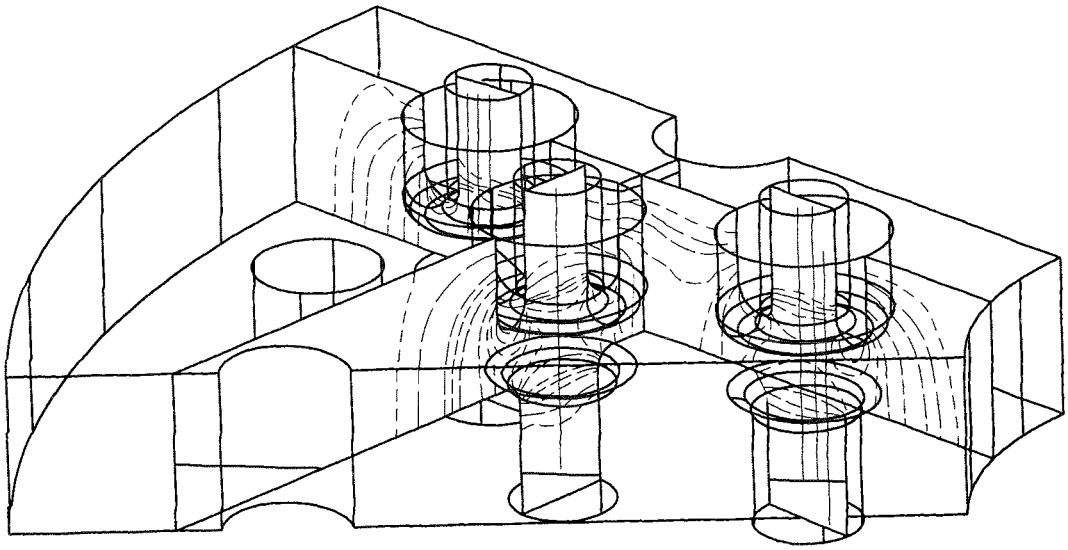
FIGS. 10*a* and 10*b* illustrate exemplary aspects of electric fields in an RF source.
Figure 10B:
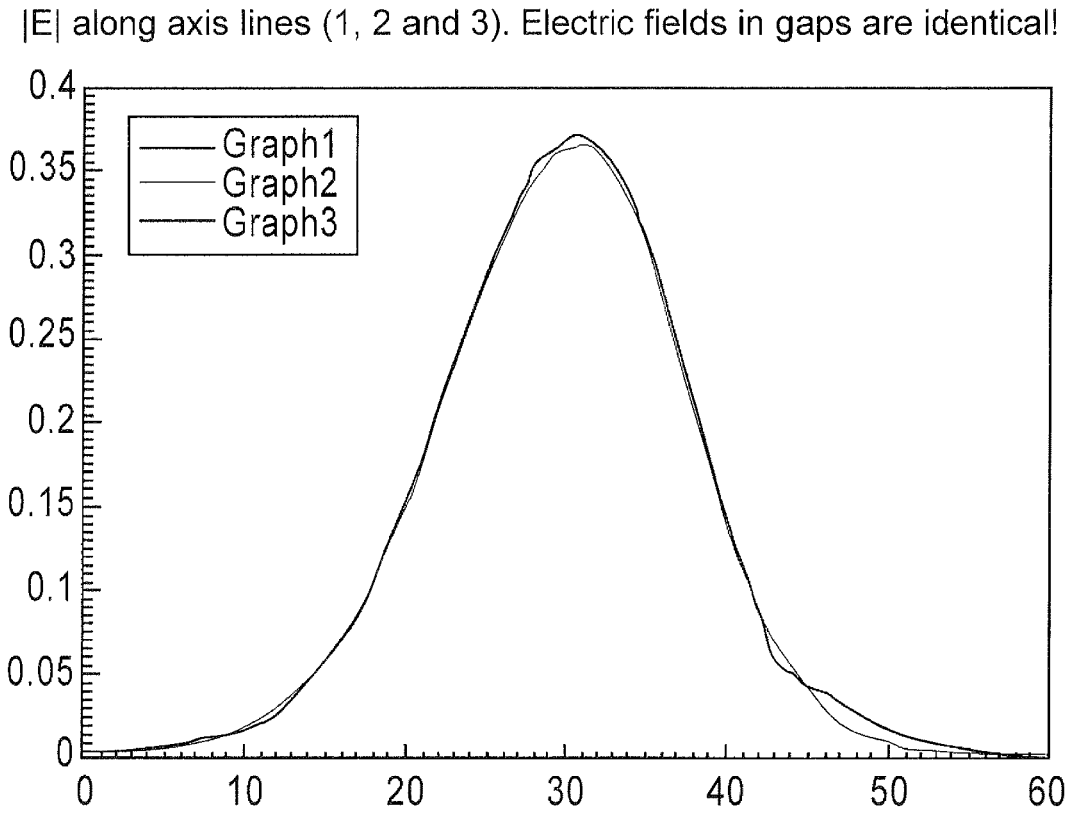

FIGS. 9*a* and 9*b* illustrate the RF fields in the output cavity in a horizontal cross section. FIG. 9*a* illustrates the electric field intensity $|E|_{XYsurface}$ in the surface z=0. FIG. 9*b* illustrates the magnetic field $H_{XYsuface}$ in the surface z=0, FIG. 10*a* illustrates RF fields in vertical cross sections of the output cavity. Electric fields in the Gap region are shown. FIG. 10*b* illustrates a longitudinal electric field in different channels. FIG. 10*b* illustrates that the electric fields in the gaps along lines 1, 2, and 3 are nearly identical.

Figure 11:
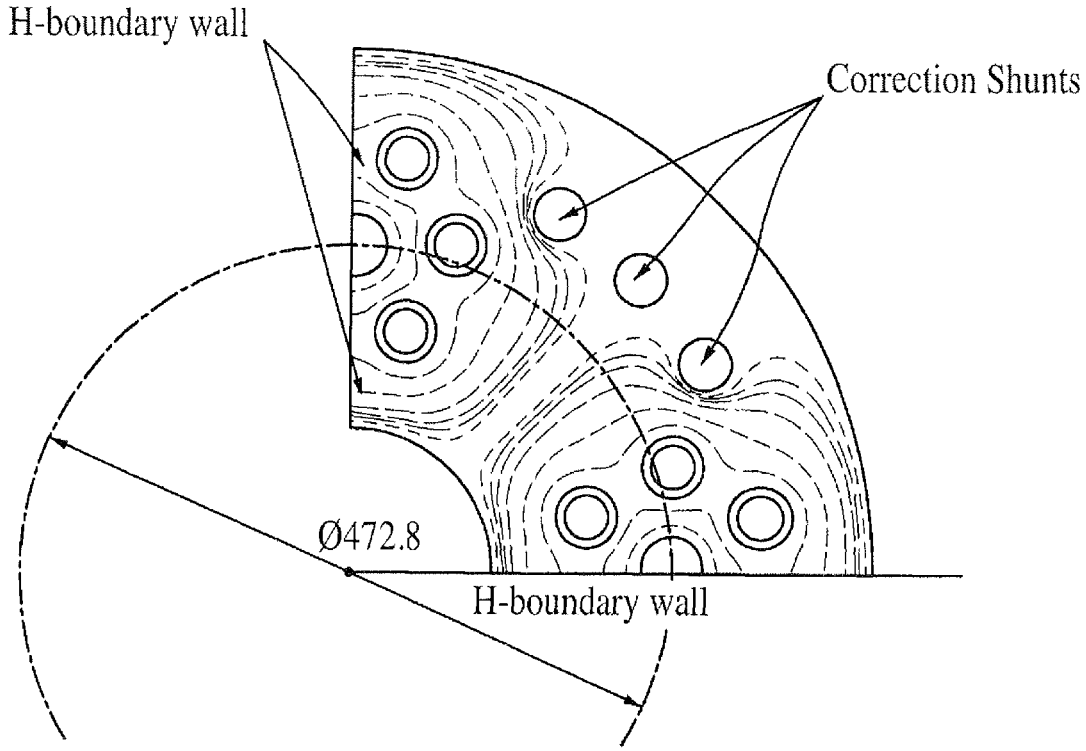
FIG. 11 illustrates exemplary aspects of electric fields in an RF source.

FIG. 11 illustrates the boundary conditions for the operating mode. Combining boundary conditions HH, HE, and EE, on a wall, all possible modes are covered. Parameters of the output cavity are shown in Table 8. FIG. 11 illustrates that by combining the boundary conditions on the symmetry planes, it is possible to calculate the spectrum of the neighboring parasitic modes.

TABLE 8

| Exemplary Mode Frequencies for the Output Cavity, in MHz | |
|---|---|
| Near to operating | Near to second harmonic |
| EE Boundary | |
| 1373 | 2297 |
| 1533 | 2996 |
| 1830 | 3058 |
| HE Boundary | |
| 1226 | 2201 |
| 1447 | 2283 |
| 1542 | 2970 |
| HH Boundary | |
| 1184 | 2133 |
| 1300 (operating mode) | 2955 |
| 1491 | 2962 |

Figure 12:
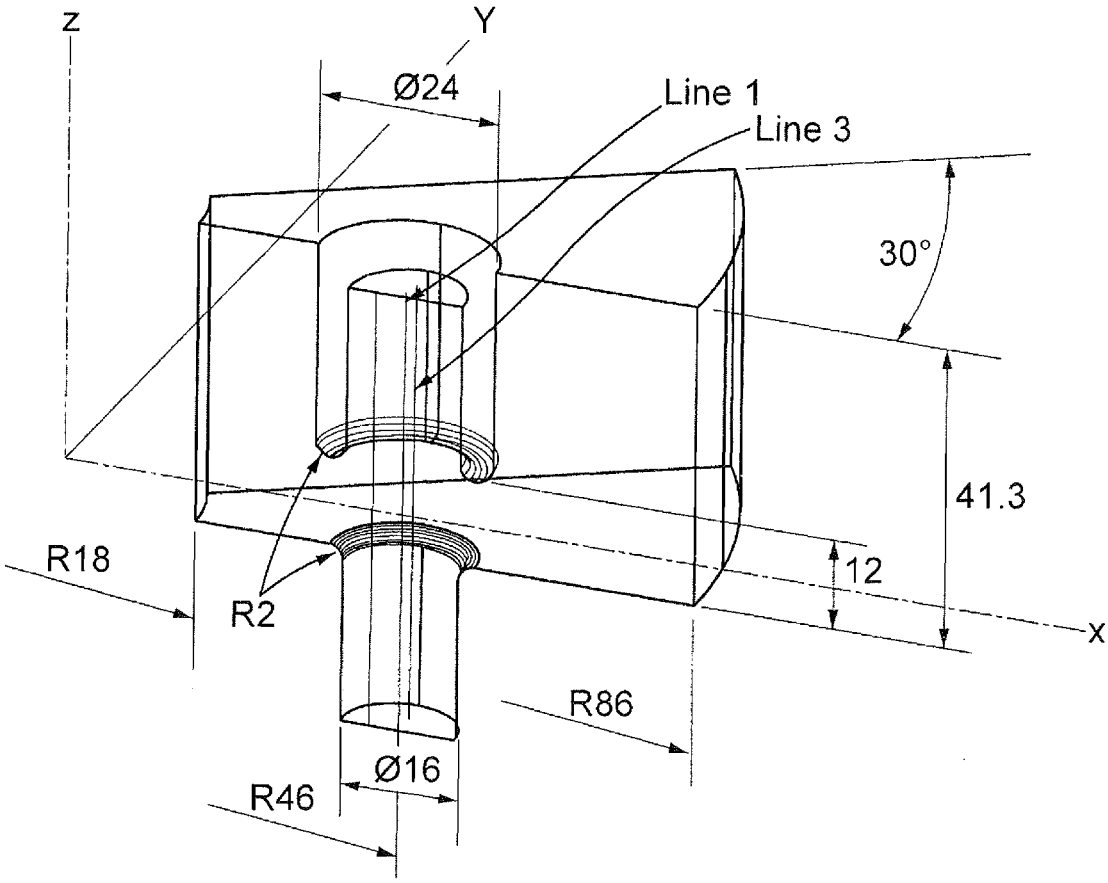
FIG. 12 illustrates exemplary aspects of a cavity for an RF source.

The gain cavity has a hexagonal symmetry. /1;12 of the geometry of the gain cavity enables a calculation of the operating and neighboring parasitic modes. FIG. 12 illustrates an exemplary cross section of a gain cavity. The corresponding field pattern is illustrated in FIG. 13. Table 9 illustrates exemplary dimensions for the gain cavity. Equation 1 can be used for R/Q calculations for 30° of a gain cavity.

$$R/Q_{Equivalent} = \frac{V^2 \cdot 9}{1.3 \cdot I_W}, \quad \text{Equation 1}$$

-continued $$V = \int_{Line} E_Z \cdot dz$$

and $$I_W = \int_{\Omega_{VIEW}} |E|^2 \cdot d\Omega$$

TABLE 9

| Exemplary Dimensions of Gain Cavity | |
|---|---|
| Mode Frequency (with shown sizes) | 1299.4 MHz |
| Gap | 12 mm |
| Height | 41.3 mm |
| R cavity | 86 mm |
| R inner | 18 mm |
| R edge | 2 mm |
| Tube Diameter | 16 mm |
| R/Q Line 1 | 121.2 Ohms |
| R/Q Line 2 | 119.5 Ohms |
| R/Q Line 3 | 120.2 Ohms |
| R/Q Line average | 120 Ohms (for 2D equivalent cavity) |
| Q (ideal Cu) | 8100 |
| Partial derivatives, dF/d(Gap) | 39 MHz/mm |
| Partial derivatives, dF/d(Height) | −21 MHz/mm |
| Partial derivatives, dF/d(R cavity) | −11 MHz/mm |
| Partial derivatives, dF/d(R inner) | 20 MHz/mm |

Figure 13A:
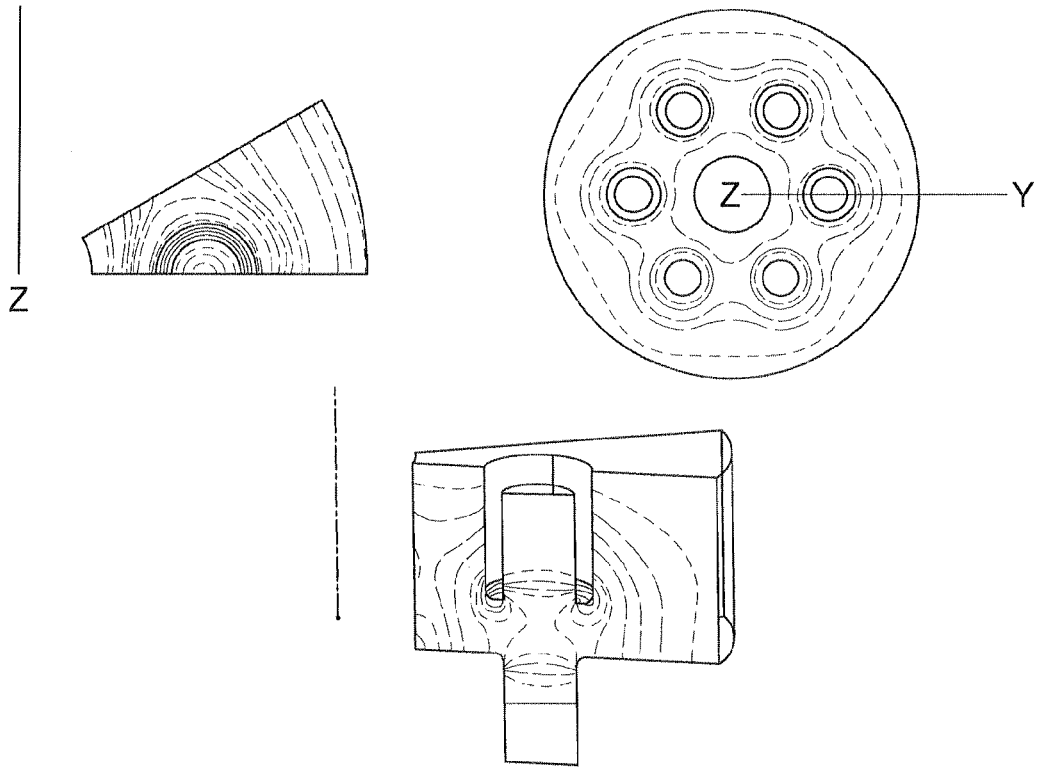
FIGS. 13*a* and 13*b* illustrate exemplary aspects of field patterns in a gain cavity.
Figure 13B:
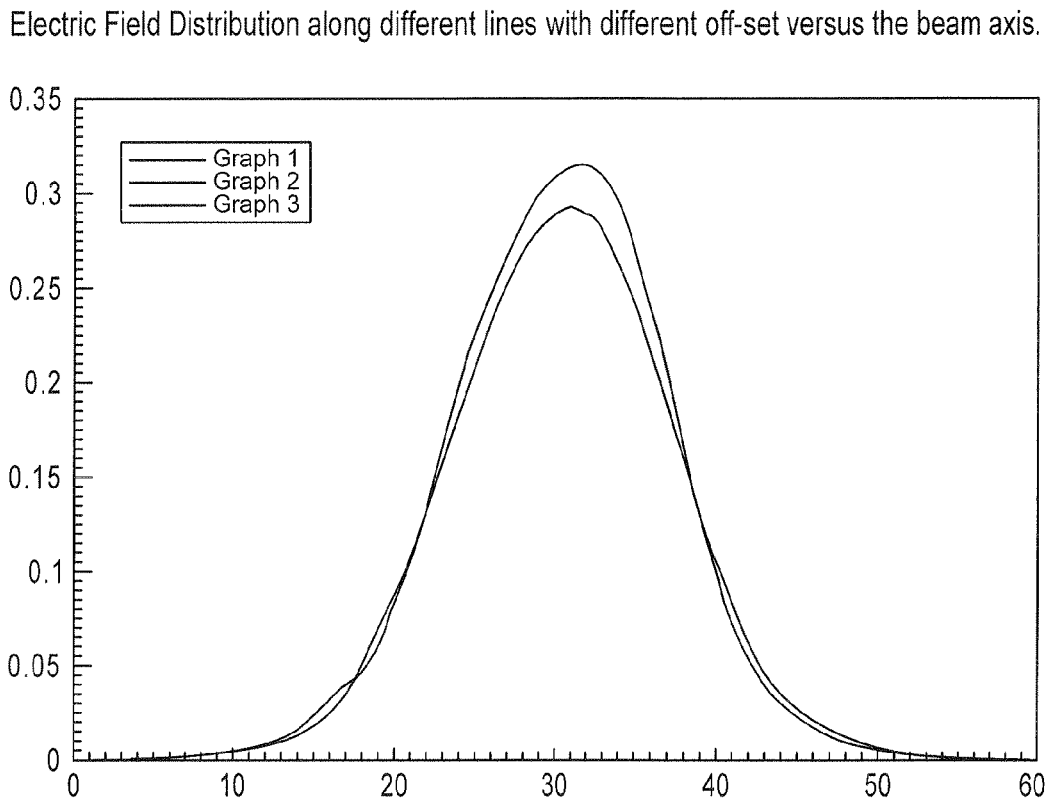

FIG. 13*a* illustrates the field pattern for a gain cavity having the exemplary dimensions. FIG. 13*b* illustrates an electric field distribution along different lines with different off-set versus the beam axis. FIG. 13*b* illustrates an acceptable amount of asymmetry caused by the influence of the neighboring drift tubes for the different lines.

Figure 14:
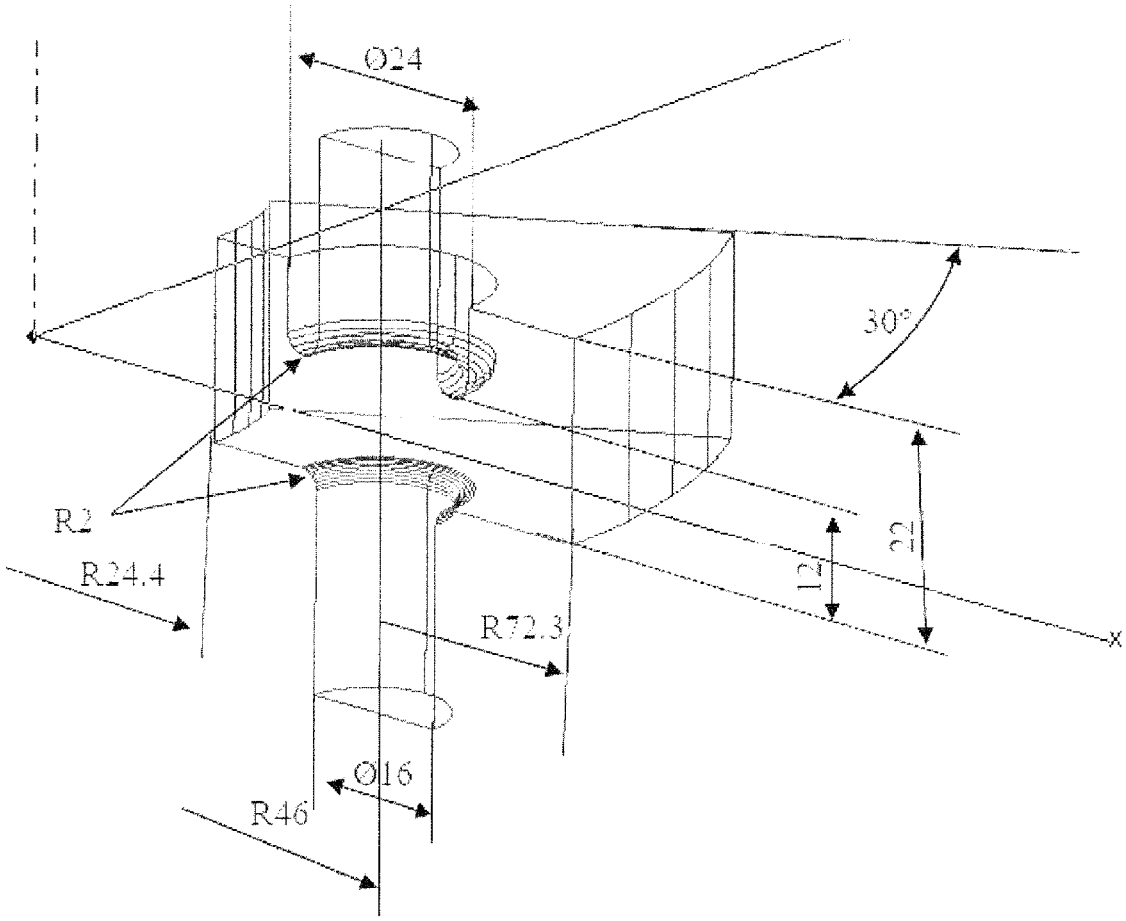
FIG. 14 illustrates aspects of an exemplary second harmonic gain cavity.

FIGS. 14*a* and 14*b* illustrate exemplary dimensions for the second gain cavity. Equation 2 can be used to determine the R/Q calculations for a 30° shape of the second gain cavity. Exemplary Dimensions for the second gain cavity are shown in Table 10, $$R/Q_{Equivalent} = \frac{V^2 \cdot 9}{1.3 \cdot I_W}, \quad \text{Equation 2}$$

$$V = \int_{Line} E_Z \cdot dz$$

and $$I_W = \int_{\Omega_{VIEW}} |E|^2 \cdot d\Omega$$

TABLE 10

| Exemplary Dimensions of Second Gain Cavity | |
|---|---|
| Mode Frequency (with shown sizes) | 2598.4 MHz |
| Gap | 12 mm |
| Height | 22 mm |
| R cavity | 72.3 mm |
| R inner | 24.4 mm |
| R edge | 2 mm |
| Tube Diameter | 16 mm |
| R/Q Line 1 | 89.7 Ohms |
| R/Q Line 2 | 86.2 Ohms |
| R/Q Line 3 | 88.9 Ohms |
| R/Q Line average | 88 Ohms (for 2D equivalent cavity) |
| Q (ideal Cu) | 7550 |
| Partial derivatives, dF/d(Gap) | 82 MHz/mm |

TABLE 10-continued

| Exemplary Dimensions of Second Gain Cavity | |
|---|---|
| Partial derivatives, dF/d(Height) | −64 MHz/mm |
| Partial derivatives, dF/d(R cavity) | −46 MHz/mm |
| Partial derivatives, dF/d(R inner) | 59 MHz/mm |

Figure 15A:
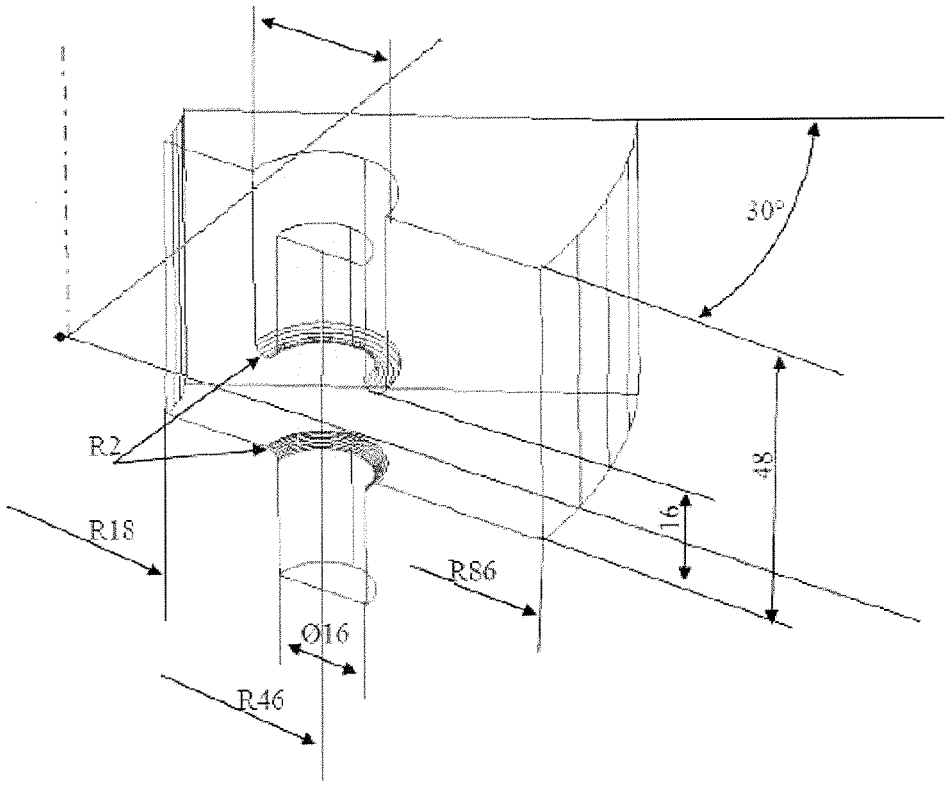
FIGS. 15*a* and 15*b* illustrate aspects of an exemplary first and second penultimate harmonic gain cavity.
Figure 15B:
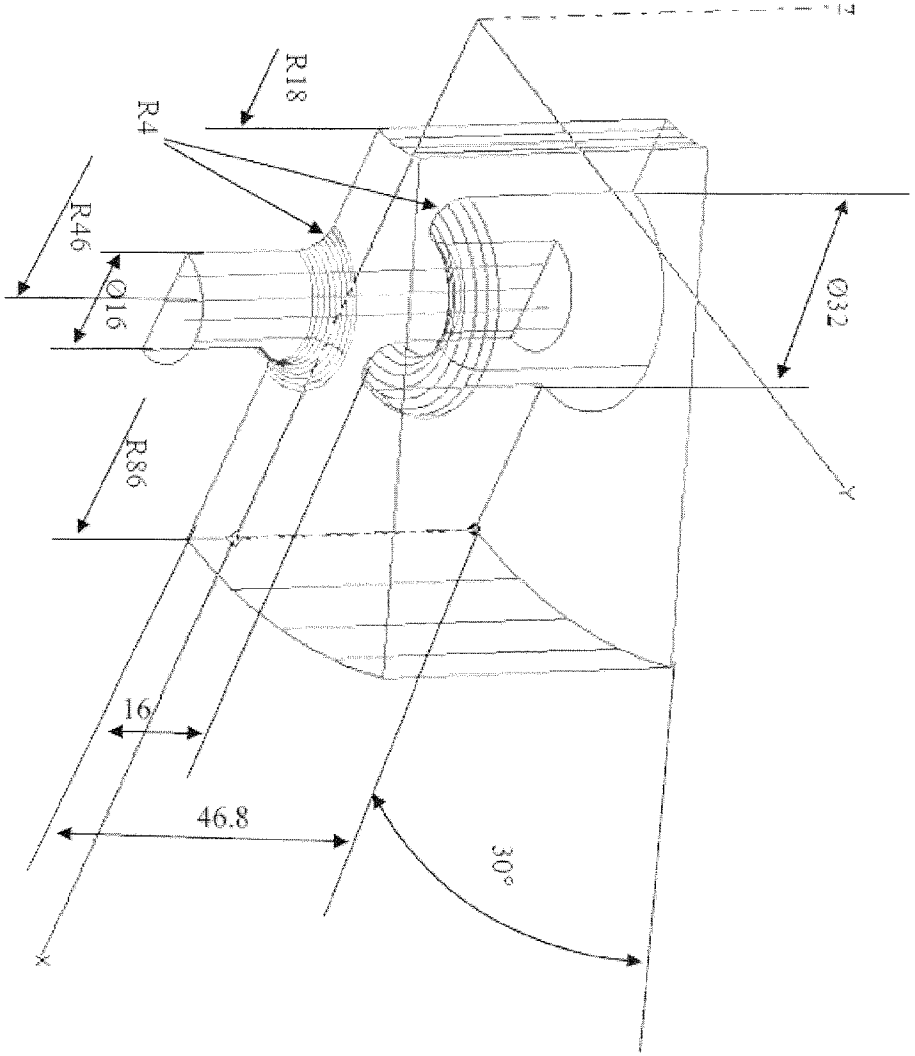

FIG. 15 illustrates exemplary dimensions for the penultimate gain cavity 1. Exemplary Dimensions for the penultimate gain cavity 2 are shown in Table 11.

TABLE 11

| Exemplary Dimensions of Penultimate Gain Cavity 1 | |
|---|---|
| Mode Frequency (with shown sizes) | 1298.7 MHz |
| Gap | 16 mm |
| Height | 48 mm |
| R cavity | 86 mm |
| R inner | 18 mm |
| R edge | 2 mm |
| Tube Diameter | 16 mm |
| R/Q Line 1 | 137.9 Ohms |
| R/Q Line 2 | 135.9 Ohms |
| R/Q Line 3 | 137.1 Ohms |
| R/Q Line average | 136 Ohms (for 2D equivalent cavity) |
| Q (ideal Cu) | 8440 |
| Partial derivatives, dF/d(Gap) | 32 MHz/mm |
| Partial derivatives, dF/d(Height) | −21 MHz/mm |
| Partial derivatives, dF/d(R cavity) | −11 MHz/mm |
| Partial derivatives, dF/d(R inner) | 18 MHz/mm |

Figure 16:
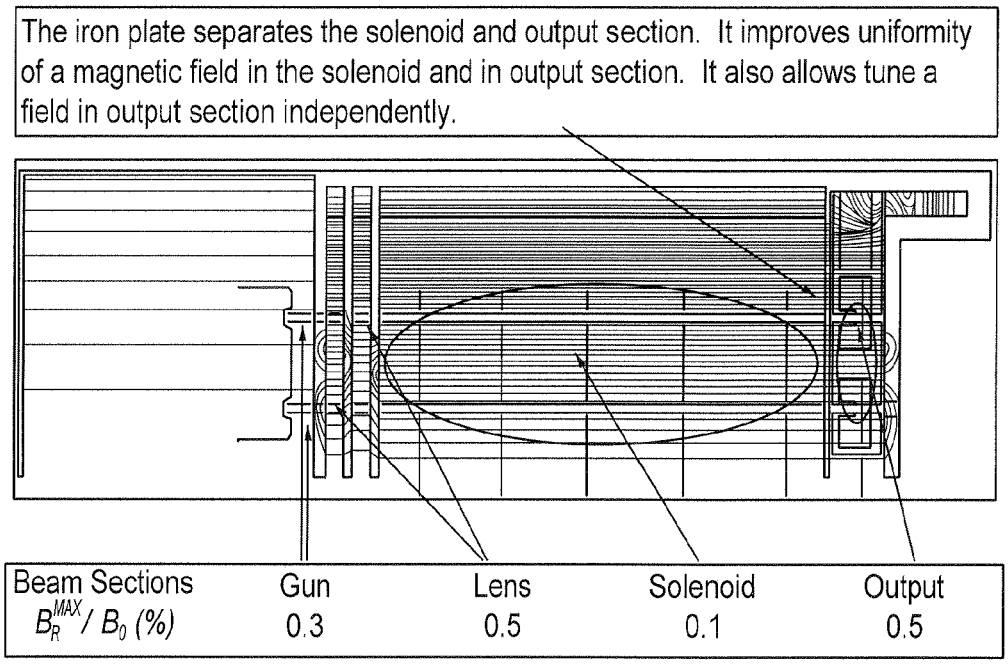
FIG. 16 illustrates exemplary aspects of a magnetic system for an RF source.

FIG. 16 illustrates exemplary dimensions for the penultimate gain cavity 2. Exemplary Dimensions for the penultimate gain cavity s are shown in Table 12.

TABLE 12

| Exemplary Dimensions of Penultimate Gain Cavity 2 | |
|---|---|
| Mode Frequency (with shown sizes) | 1300.2 MHz |
| Gap | 16 mm |
| Height | 46.8 mm |
| R cavity | 86 mm |
| R inner | 18 mm |
| R edge | 4 mm |
| Tube Diameter | 16 mm |
| R/Q Line 1 | 116.1 Ohms |
| R/Q Line 2 | 114.7 Ohms |
| R/Q Line 3 | 116.4 Ohms |
| R/Q Line average | 116 Ohms (for 2D equivalent cavity) |
| Q (ideal Cu) | 7660 |
| Partial derivatives, dF/d(Gap) | 34 MHz/mm |
| Partial derivatives, dF/d(Height) | −20 MHz/mm |
| Partial derivatives, dF/d(R cavity) | −12 MHz/mm |
| Partial derivatives, dF/d(R inner) | 21 MHz/mm |

TABLE 13

Summary of Exemplary Dimensions of Gain Cavities

| Cavity Number | Input | $2^{nd}$ | $3^{d}$ SHC | $4^{th}$ | $5^{th}$ | Output |
|---|---|---|---|---|---|---|
| Mode | Mixed TM 210 | TM 010 | TM 010 | TM 010 | TM 010 | Mixed TM 210 |
| Resonance Frequency (MHz) | 1300 | 302 | 2588 | 1409 | 1348 | 1300 |
| Total R/Q along Beam-let axis (Ohm) | 5.83 | 20 | 14.46 | 22.66 | 19.33 | 4.25 |
| $R/Q_{axis}$ for 1 beamlet | 140 | 20 | 88 | 136 | 116 | 102 |
| Own Quality (Cu) | 9100 | 8100 | 7550 | 8440 | 7660 | 7960 |
| Circuit Loaded Quality | 400* | — | — | — | — | 47 |
| Cavity Center Position (mm) | 0 | 10 | 200 | 290 | 390 | 470 |
| Cavity gap (mm) | 16 | 12 | 12 | 16 | 16 | 12 |
| Cavity Diameter (mm) | 472.8 | 72 | 144.6 | 172 | 172 | 472.8 |
| Cavity Height (mm) | 39.2 | 41.2 | 22 | 45.1 | 44 | 31.1 |
| Cavity Inner Diameter (mm) | 126 | 36 | 48.8 | 36 | 36 | 126 |

In Table 13, the beam load Quality was 400, beam detuning was −2 MHz based on ID simulation. It may be useful to slightly overcouple for stability and in order to obtain a wider band width, as well as to make Q _loaded approximately 300. This may cause a slight loss in gain.

Magnetic System

The magnetic system should be configured to achieve an optimal field profile that provides maximum tube efficiency. The magnetic system should also provide optimal beam matching with the electron gun and optimal beam dispersion of the beam in the four-section beam collector with a peak power up to approximately 10 MW and average power up to approximately 300 kW.

The magnetic system is divided by iron pole pieces into regions of independent control. These are regions of the gun, the matching optical system comprises a pair of lenses, the solenoid, and the output coil. The system of coils provides compensation of transverse fields on the axis of each beam-let to a level of ±0.5% of the longitudinal field. Non-compensated values are the angular components of magnetic field produced by beam currents. The cross-sectional area of the magnetic system should be configured to provide a large enough space to be occupied by a total beam current. The transverse fields produced by this current should not exceed the abovementioned level. The proposed magnetic system provides the necessary magnitude of a magnetic field in the solenoid of 1 kGs, and insignificant values of tangential magnetic fields. Deviations of a beam-let from an axis should not exceed approximately 0.5 mm.

Other features may include a pair of matching lenses provide focusing of beam-lets over a wide range of parameters. Independently adjustable magnetic field in the output section may allow one to optimize efficiency of klystron and to minimize current interception of beam on walls. Sources of tangential magnetic fields may be considered and minimized.

FIG. 16 illustrates a general view of a magnetic system and the relative arrangement of its parts. The magnetic aspects of the system may include a lens, a solenoid, and an output section. An iron plate may be used to separate the solenoid and output section. This improves uniformity of a magnetic field in the solenoid and in the output section. It also enables the tuning of a field in the output section independently. The peak value of a magnetic field in iron of the lens section is approximately 10 kGs, and the peak value of magnetic field in iron of the output section is approximately 13 kGs.

Figure 17:
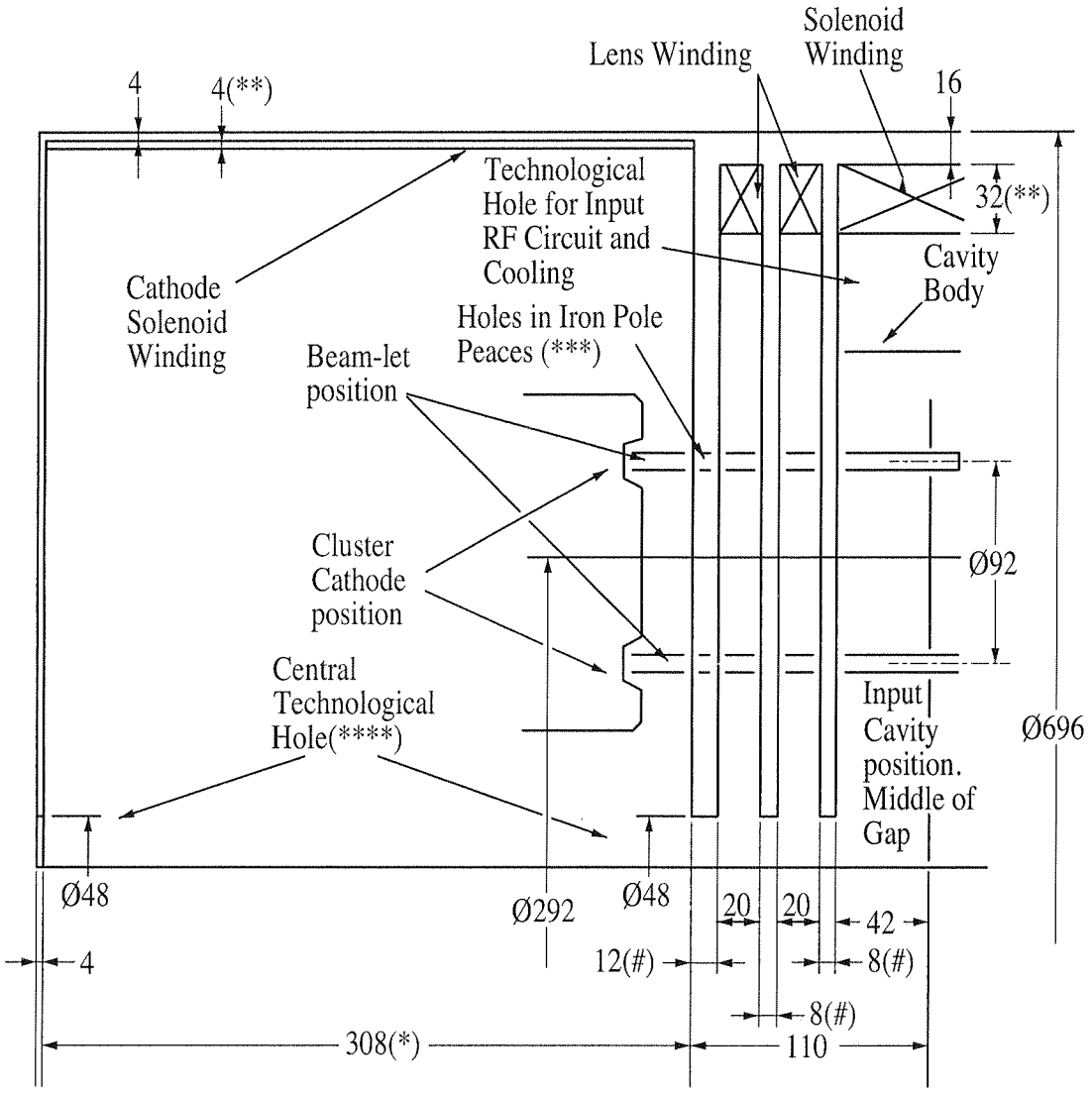
FIG. 17 illustrates exemplary aspects of a magnetic system for an RF source.

FIG. 17 illustrates aspects of a magnetic system. In FIG. 17, the thickness (#) of iron pole pieces may be increased. It does not change properties of the gun and tune of a beam. The dimension marked as (*) depends on the size of a gun and can be increased. The size () of the solenoid winding depends on a design of a winding and can be changed. Exemplary dimensions marked (*) are described above. The central technological hole (****) does not impair of uniformity of a magnetic field.

Figure 18:
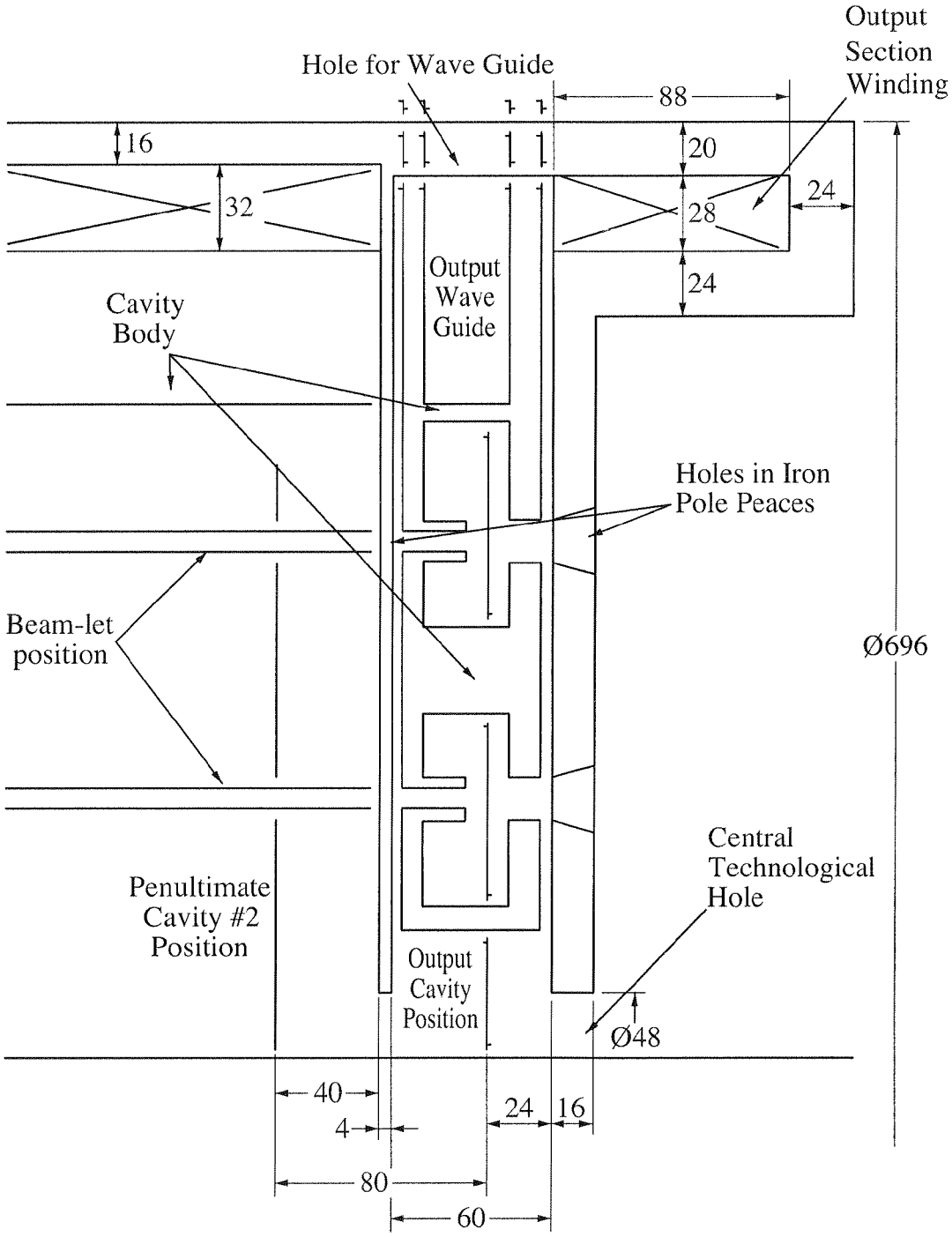
FIG. 18 illustrates exemplary aspects of an output section of a magnetic system for an RF source.

FIG. 18 illustrates an exemplary configuration of an output section of the magnetic system aspects.

Figure 19A:
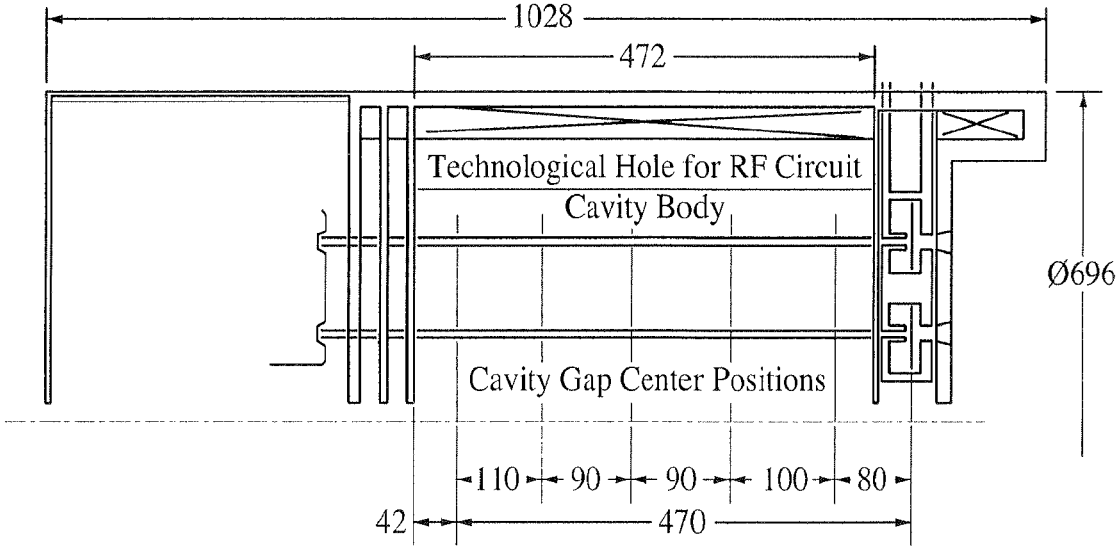
FIGS. 19*a* and 19*b* illustrate exemplary aspects of a magnetic system for an RF source.
Figure 19B:
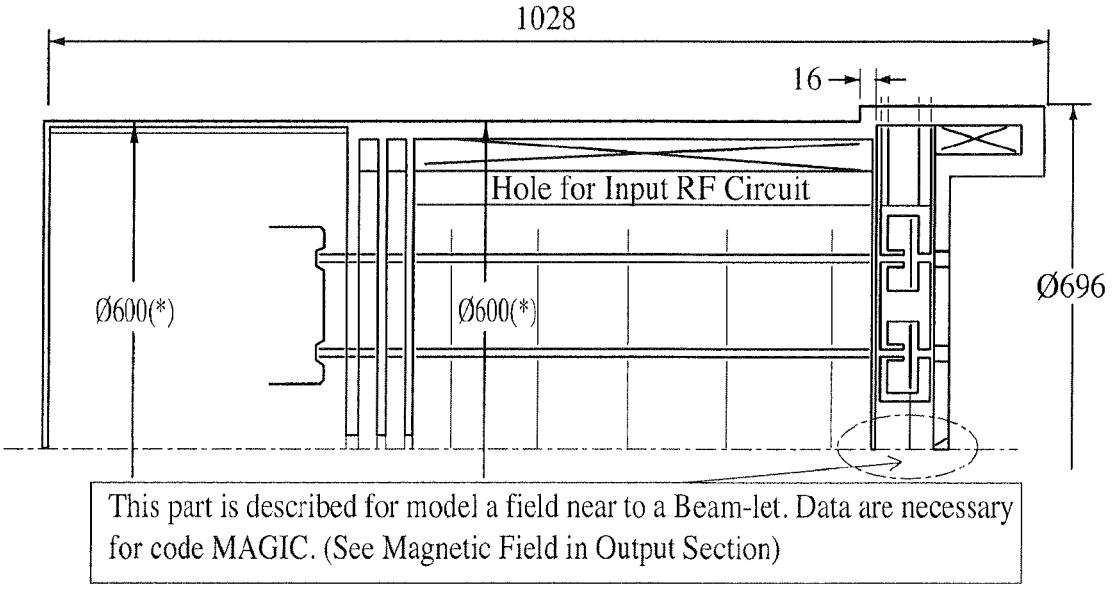

FIG. 19*a* illustrates a configuration of an output section of a magnetic system. FIG. 19*b* illustrates a variation of an output section of a magnetic system having a reduced diameter of the solenoid. The diameter of the solenoid can be reduced somewhat, but the diameter of the output section should not be reduced. Reduction of the diameter of the output section causes deterioration of uniformity of a magnetic field in the output section (*). This diameter depends on the size of the hole for the input RF circuit.

Sources of transverse (radial) magnetic field include: (1) final magnetic permeability of material; (2) a technological gap between an iron pole piece of the tube and a pole piece of magnetic system; (3) axial shift between a position of an iron pole piece of the device and a pole piece of magnetic system; and (4) a technological gap between a winding of magnetic system and iron.

With respect to the final magnetic permeability of the material, from the air side there is a tangent to a surface of iron of a component of the magnetic field, equal to $B_{air}=B_{iron}/\mu$. This value is insignificant for area of the solenoid. In the area of a gun where the longitudinal field is not large, it more distinct and is equal to $B_R^{MAX}/B_0=0.3\%$. This value is acceptable.

With respect to a technological gap between an iron pole piece of the tube and a pole piece of magnetic system and the axial shift, a shift of one surface with respect to another surface, e.g. 0.6 mm for a gap size equal to 0.2 mm would cause the parameter in the area of the solenoid to become equal to $B_R^{MAX}/B_0=0.7\%$, which is not acceptable.

With respect to the technological gap between a winding of magnetic system and iron, there will exist necessarily a technological gap between a winding and a plane of iron. The perturbed magnetic field can be presented as superposition of not perturbed field of the solenoid without a gap and the fields, created by the coil filling the volume of a gap with a current equal to $-I_{Soleniod}/L_{Soleniod}\cdot L_{Gap}$. And a direction of this current is opposite to a direction of a current of the solenoid. This perturbation is strong enough and results in $B_R^{MAX}/B_0=1.7\%$.

Figure 20:
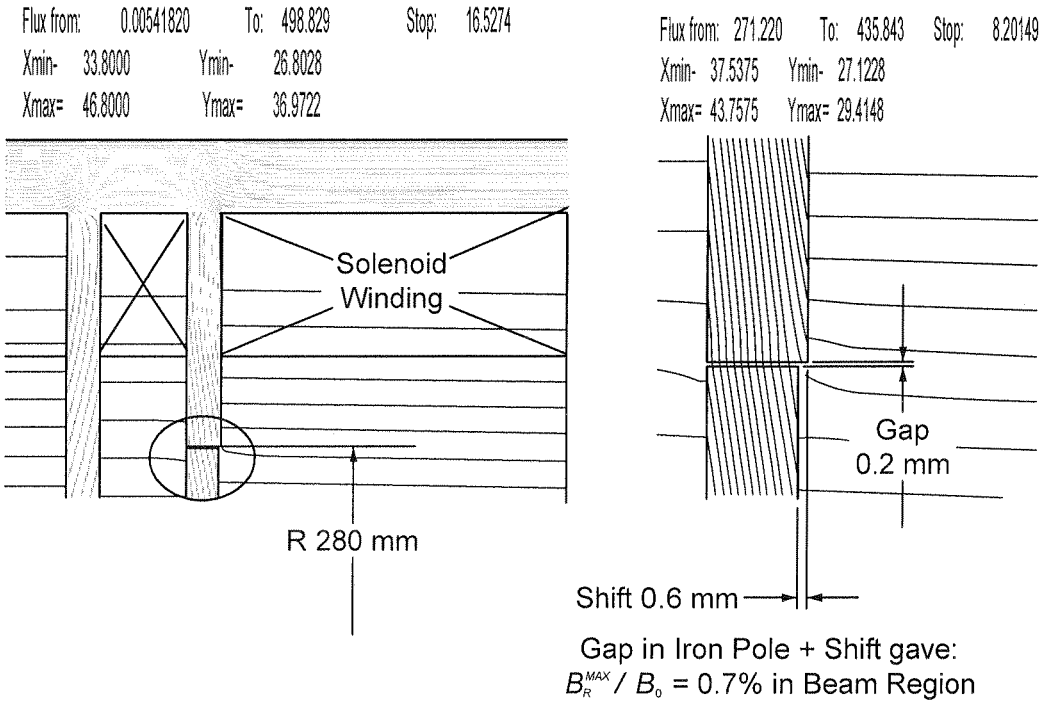
FIG. 20 illustrates exemplary aspects of a magnetic system for an RF source.
Figure 21:
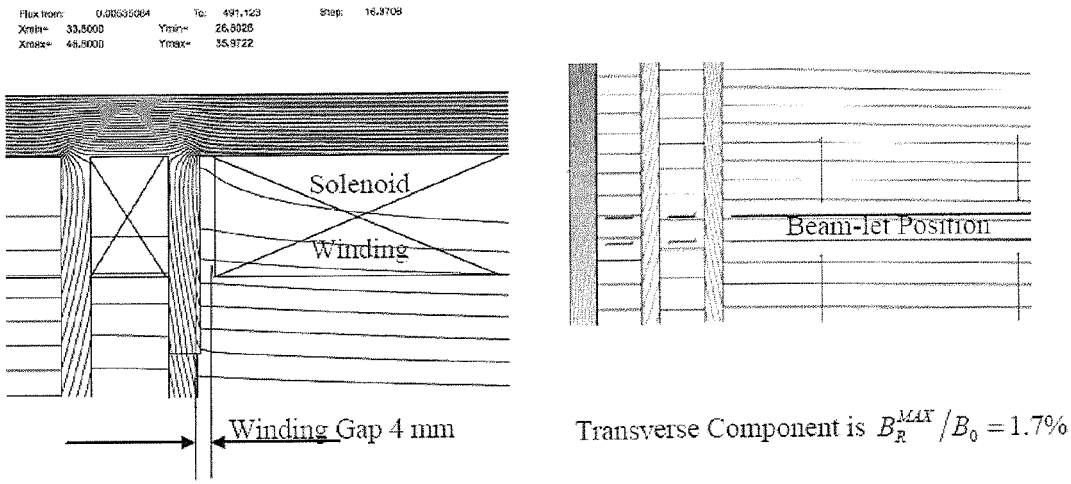
FIG. 21 illustrates exemplary aspects of a magnetic system for an RF source.

FIG. 20 illustrates that the technological gap in iron pole pieces can be a source of a transverse/radial magnetic fields. FIG. 21 illustrates that the technological gap between a winding and iron may also be a source of a transverse magnetic field.

Compensating Coils

Compensating coils can be used to compensate these four types of perturbations. The current of the compensating coil should be equal approximate such value given by equation 3, and should coincide on a direction with a current of the solenoid.

$$I_{Compensating}=I_{Soleniod}/L_{Soleniod}\cdot(2L_{Gap}+L_{Coil}) \qquad \text{Equation 3.}$$

Figure 22:
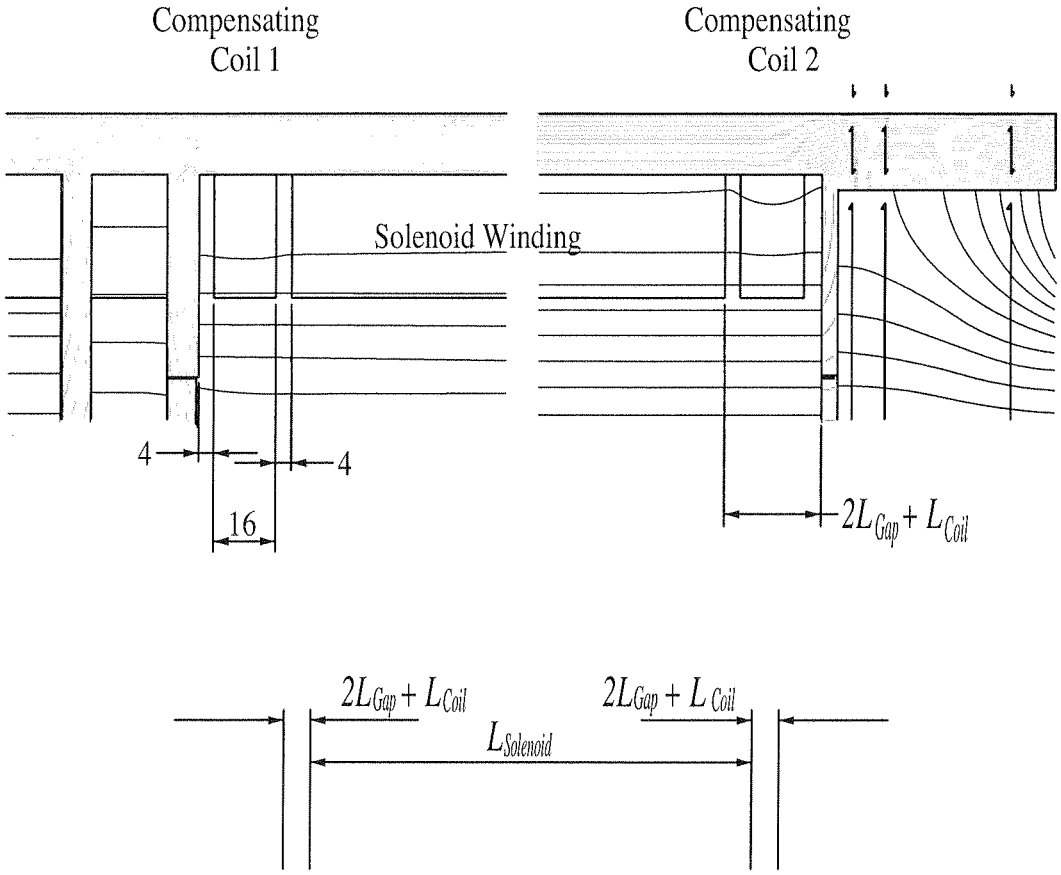
FIG. 22 illustrates exemplary aspects of a magnetic system for an RF source.
Figure 23:
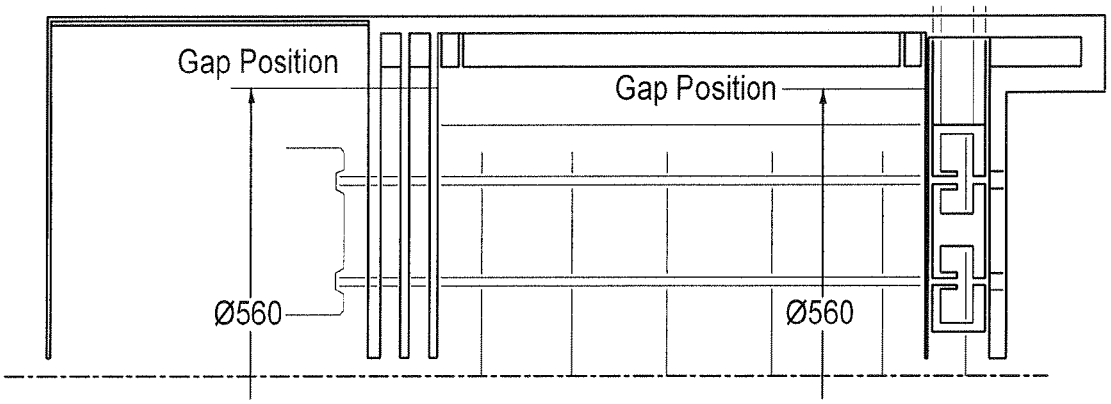
FIG. 23 illustrates exemplary aspects of a magnetic system for an RF source.

FIG. 22 illustrates result of compensation. A transverse component in solenoid $B_R^{MAX}/B_0=0.1\%$ can be recovered. FIG. 23 illustrates an exemplary arrangement of compensating coils in the magnetic system.

Figure 24:
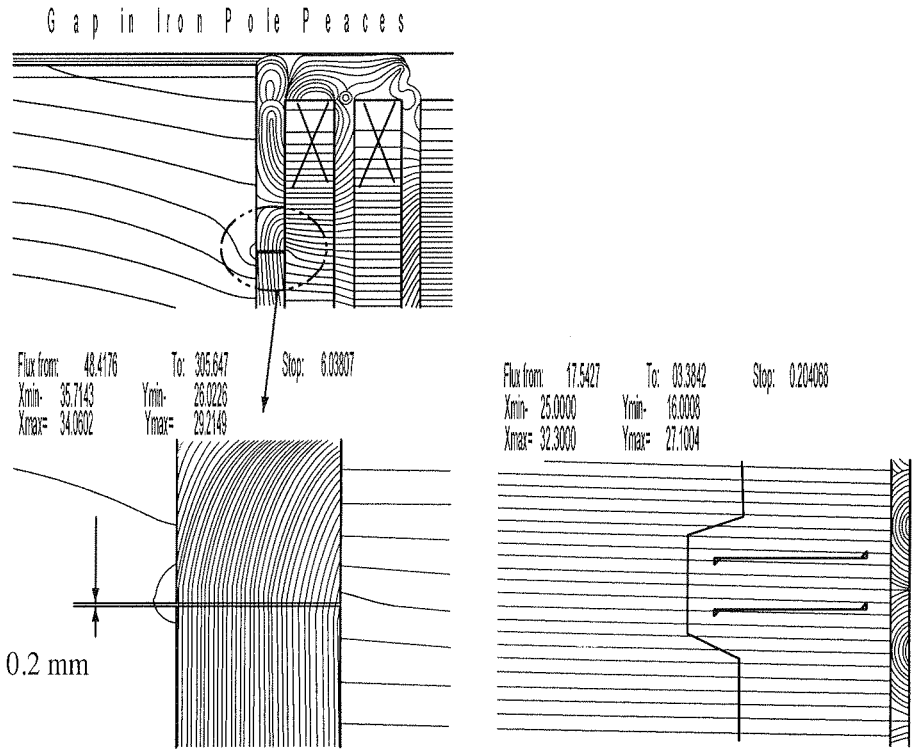
FIG. 24 illustrates exemplary aspects of a magnetic system for an RF source.

FIG. 24 illustrates perturbations of a field that may be present in the region of a gun. The gap in iron pole pieces creates a magnetic field in the region of a gun. $B_R^{MAX}/B_0=1.2\%$, $B_R^{MAX}$32 1.4 Gs.

Figure 25:
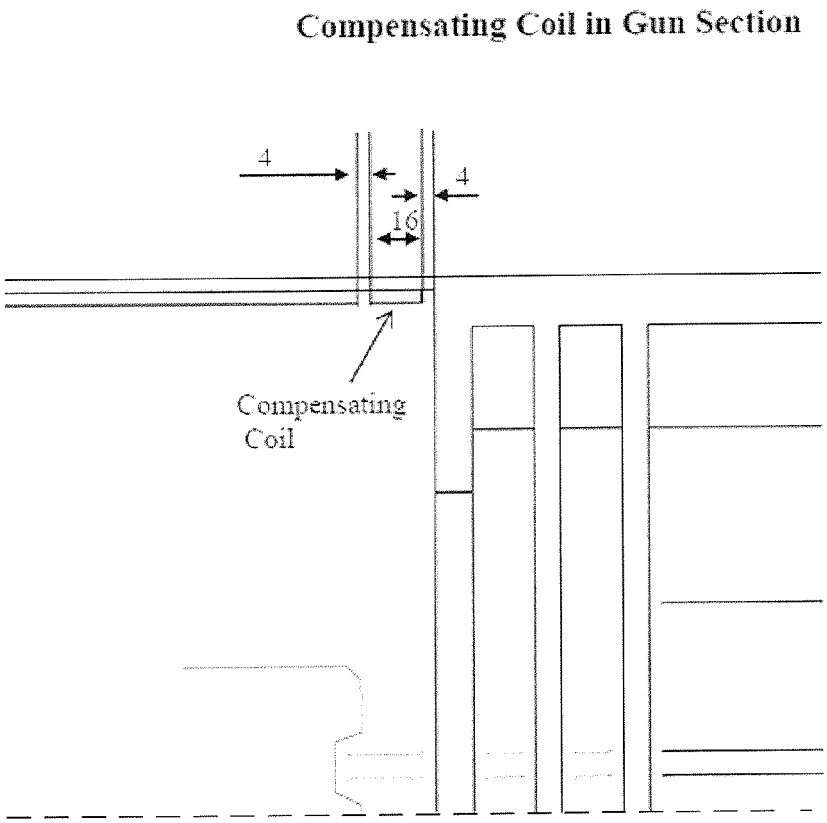
FIG. 25 illustrates exemplary aspects of a magnetic system for an RF source.
Figure 26:
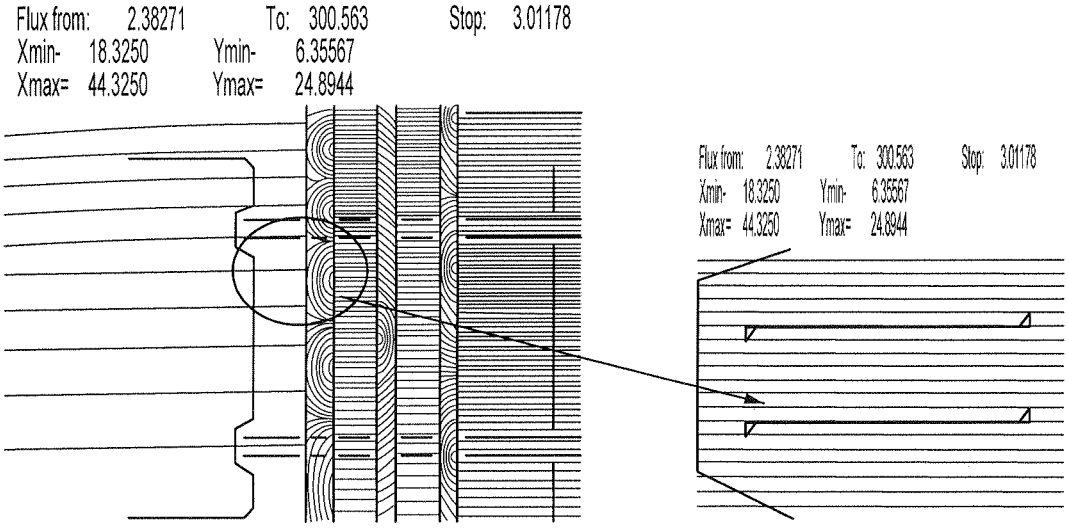
FIG. 26 illustrates exemplary aspects of a magnetic system for an RF source.

FIG. 25 illustrates the arrangement of compensating coils in a gun section of a magnetic system. FIG. 26 illustrates the result of such compensation for reducing a transverse component of magnetic field in the gun section. For example, $B_R^{MAX}/B_0=0.35\%$ , $B_R^{MAX}=0.4$ Gs!.

There are criteria for permissible values of a transverse magnetic field. For a particle moving along an axis Z, a longitudinal field $B_7$ operates as well a transverse component of magnetic field $B_R$. The particle starts to make cyclotron rotation of radius R, which can be written as $\int B_R dz=R\cdot B_Z$.

If transverse field $B_R$ is constant on length L, the particle on the average will deviate from non-perturbed trajectory on value R, $B_R\cdot L=R\cdot B_Z$. Thus, if not to consider forces of a space charge, it is possible to write the following permissible rough criterion for value of a transverse magnetic field, $\int B_R dz<R\cdot B_Z$, where R is a maximum deviation of a beam. If R=0.05 cm, $B_Z$=1 kGs and thus it will get for short extended transverse magnetic field, $\int B_R dz<0.05$ kGs·cm . For a solenoid of length L=50cm with transverse extended magnetic field criterion is $B_R/B_Z<10^{-3}=0.1\%$.

Figure 27:
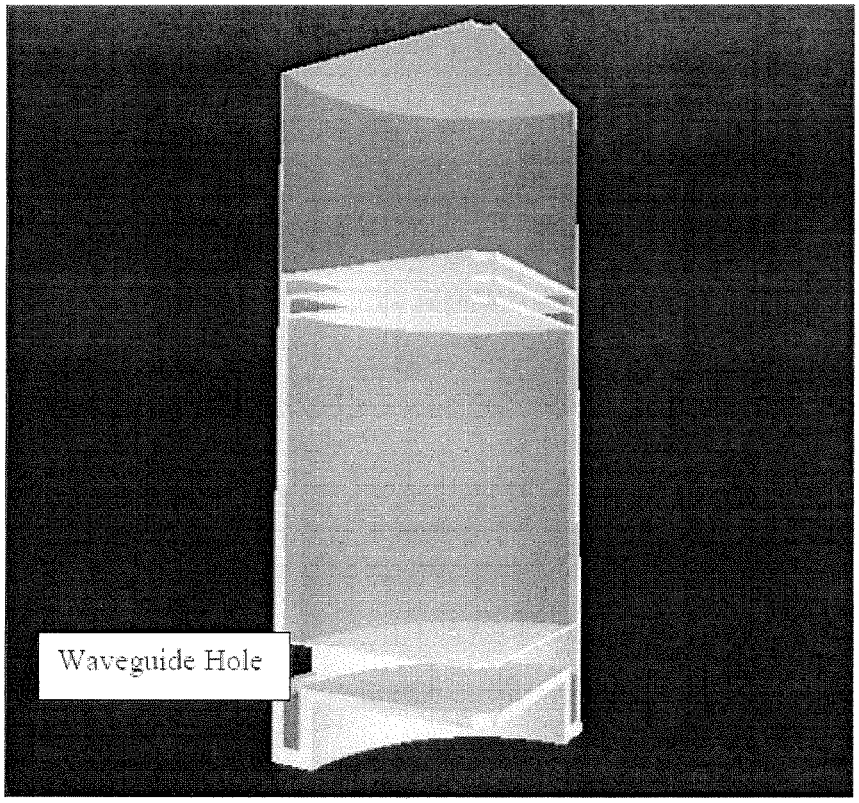
FIG. 27 illustrates exemplary aspects of a waveguide for an RF source

FIG. 27 illustrates aspects of 3D perturbation in the magnetic system, for a cut-away portion of the magnetic system without beam-let holes. Possible sources of 3D heterogeneity for a magnetic field include holes in iron for a wave guide and holes for a beam-let in iron pole pieces.

There can be a problem of vacuum connection of iron and copper on the big areas. The distance between holes for a beam-let achieves 380 mm. On this size a difference of thermal expansion coefficients of iron and copper for temperature, for example 500 degrees, achieve value of 0.6 mm. It means that at the brazing and at technological heating there are big deformations and reliable vacuum connection to receive it will not be possible. The problem does not arise in connection with the vacuum brazing of copper and iron rings, as shown herein. Other parts of a pole piece have an opportunity of small shifts to compensate thermal expansion.

At heating deformation do not result in mechanical stress. The iron ring is located symmetrically concerning an axis of a beam-let and compensates the asymmetry arising at possible small shift of other part of iron pole pieces after assembly of the device. Other solutions may also be applied to this problem.

Figure 28:
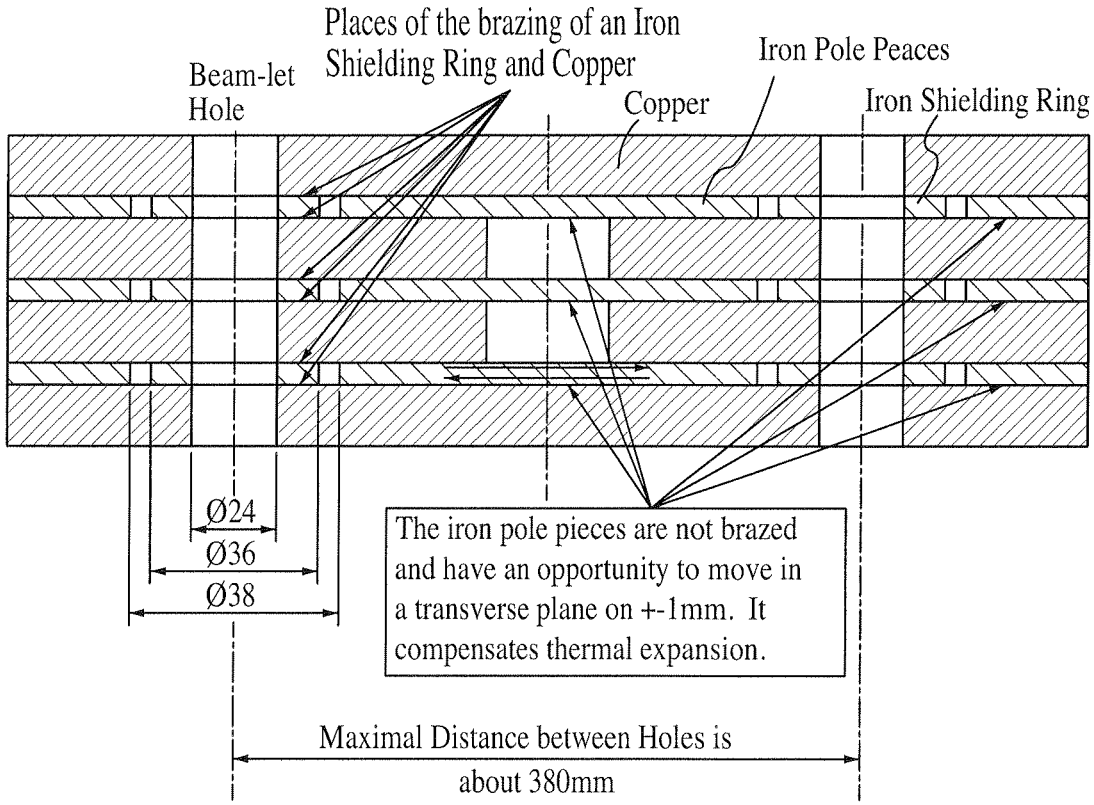
FIG. 28 illustrates exemplary aspects of a shielding ring for an RF source.

FIG. 28 illustrates a lens region, the area of the lens being one in which the problem arises in connection with the displacement of iron and copper relative to each other, as shown. By installing a shielding ring, the transverse magnetic field can be decreased considerably, e.g.

$$\int_1^2 B_{Transverce}\cdot dz = 0.0016kGs\cdot\text{cm}.$$

Displacement of a hole in iron concerning an axis of a beam on 1 mm results in significant perturbation of beam, and is unacceptable, e.g.

$$\int_1^2 B_{Transverce}\cdot dz = 0.036kGs\cdot\text{cm}.$$

Figure 29:
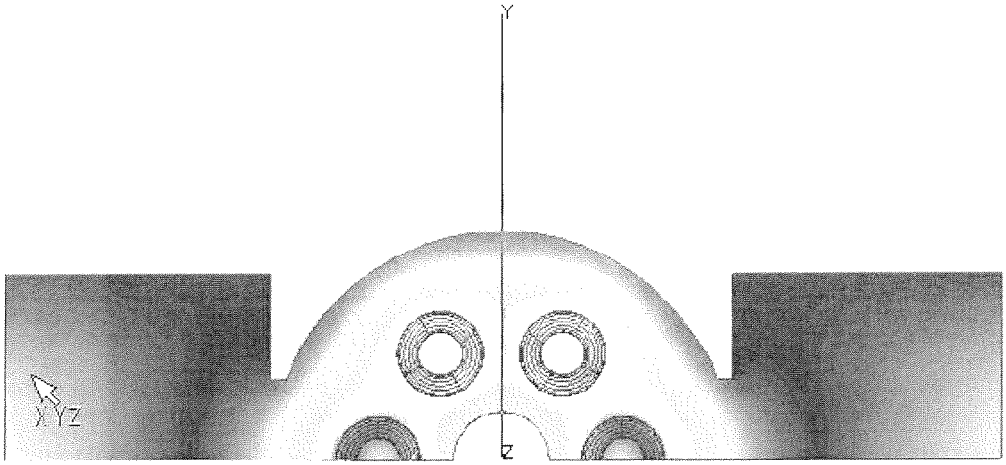
FIG. 29 illustrates exemplary aspects of a field diagram for an RF source. source.

The system may further include a coupling arrangement from the output cavity into two integral output waveguides and windows. In FIG. 29, the arrangement of output wave guides and windows is shown. Calculations using HFSS show reduction of uniformity of conditions for beam-lets and necessity of correction of geometry of the cavity for reduction of heterogeneity. FIG. 29 illustrates a map of fields in the output cavity of an exemplary 2.5 MW klystron.

Cluster Diode Gun

Aspects may include both a 2.5 MW cluster diode gun with six cathodes and a combined 10-MW Gun that produces 60 kV, 12.5 an electron beam-lets. The current density on the cathode should not exceed 2.7 A/cm2. This can be matched into the RF system of the MBK with an axial guide magnetic field of about 1 kG in order to provide good beam focusing and lack of current interception that is essential for operating at high average power.

Aspects may further include a matching double lens magnetic system. This can be a rather convenient tool for adjustment of the tube. Independently changing magnetic fields in the regions of the gun, lenses, in the solenoid it can be possible to match a beam without scalloping over a wide range of beam diameters and to change magnetic field from 1 to 2 times or more of Brillouin field. Tables 14-16 provide exemplary parameters for such a gun and corresponding magnetic system parameters.

TABLE 14

| Exemplary Gun Parameters | |
|---|---|
| Number of Cathodes in one Gun unit | 6 |
| Beam Voltage | 60 kV |
| Beam-let Current | 12 A |
| Beam-let Micro Perveance | 0.816 |
| Peak Cathode Loading | 2.1 A/cm$^2$ |
| Cathode Loading in Center | 1.6 A/cm$^2$ |
| Peak of Electric Field on Focus Electrode | 65 kV/cm |
| Cathode Diameter | 28 mm |
| Diameter of Focus Electrode | 164 mm |
| Diameter of Anode | 192 mm |

TABLE 15

| Exemplary Beam-let and Magnetic System Parameters | |
|---|---|
| Beam-let tube diameter | 16 mm |
| Operating Beam-let Diameter | 10 mm |
| Operating Magnetic Field in Solenoid | 1000 Gs |
| Operating Magnetic Field on Cathode | 124 Gs |
| Brillouin Magnetic Field ($D_{beam}$ = 10 mm) | 370 Gs |
| Brillouin Relationship ($B_{solenoid}/B_{Br}$) | 2.7 |
| Operating Current in Cathode Solenoid | 96.25 A-turn per cm |
| Operating Current in Main Solenoid | 801.4 A-turn per cm |

TABLE 16

| Exemplary Matching Lens Properties | |
|---|---|
| Number of Lens | 2 |
| Number of Pole Peaces | 3 |
| Operating Current in 1$^{st}$ Lens | 1467 A-turn |
| Operating Current in 2$^{nd}$ Lens | 1075 A-turn |
| Gap of 1$^{st}$ Lens | 20 mm |
| Gap of 2$^{nd}$ Lens | 20 mm |
| Aperture Diameter | 24 mm |
| Thickness of 1$^{st}$ Iron Pole Peaces | 10 mm |
| Thickness of 2$^{nd}$ Iron Pole Peaces | 6 mm/8 mm |
| Thickness of 3$^{rd}$ Iron Pole Peaces | 6 mm/8 mm |

With respect to the cathode and beam optics, the choice of low cathode loading equal to 2.1 A cm$^2$ can be positive both from the point of view of lifetime of the cathode and for reduction of intensity of electric field on the surface of a focusing electrode down to 65 kV cm which is considered safe for electron devices with a voltage pulse width equal to a millisecond and more. The choice of cathode geometry can minimize this value too. An estimation of 3D effects arising from nearest beam-lets and their cathodes shows that they do not exceed 5%. This implies that the perveance in 3D geometry can differ from model-based 2D geometry by about 5%, and difference of axes of the ellipse formed by a contour of a beam-let does not exceed of 5%. This criterion seems quite acceptable. The beam is rather sensitive to cathode conditions, but the application of the confined flow and increasing of magnetic field up to value of twice the Brillouin field stabilizes its geometry sufficiently.

With respect to the cluster gun, for practicality, the gun is divided into four structurally independent cluster guns with 6 beam-let cathodes in each. This is dictated by the huge required total micro-perveance, equal to 19.6. A gun with such a perveance can be susceptible to parasitic oscillations. A cluster gun with a total micro-perveance of 5, can avoid this danger. Electric coupling of neighboring cluster guns is possible. Applying absorbing material into the gun tank in order may further suppress parasitic oscillation, if needed.

Figure 30A:
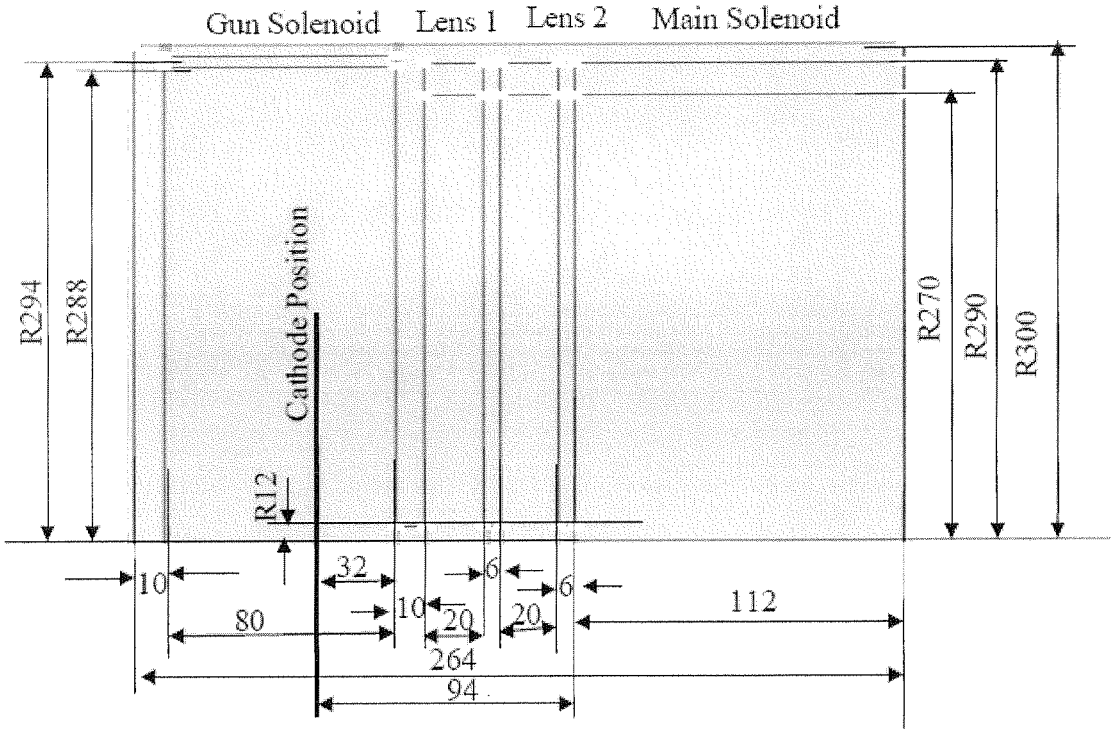
Figure 30B:
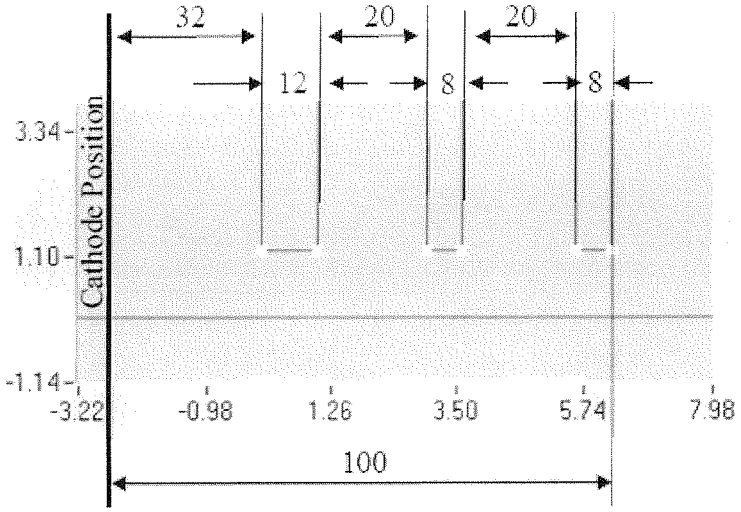

FIGS. 30*a* and 30*b* illustrate an input part of the magnetic system for a gun. For a reduction of a magnetic induction in iron, the thickness of the iron pole pieces can be increased. This will not change the property of a lens. FIG. 30*b* illustrates a corresponding field map.

Figures 31A, 31B:
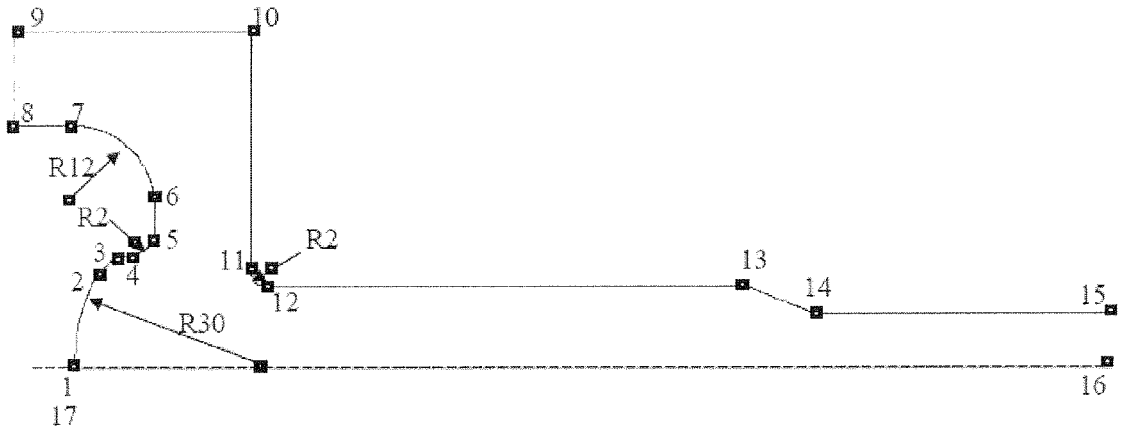
FIGS. 31*a* and 31*b* are exemplary dimensions for an implementation of an RF source.

FIGS. 31*a* and 31*b* illustrate an exemplary gun geometry, and corresponding table of coordinate points.

Figure 32A:
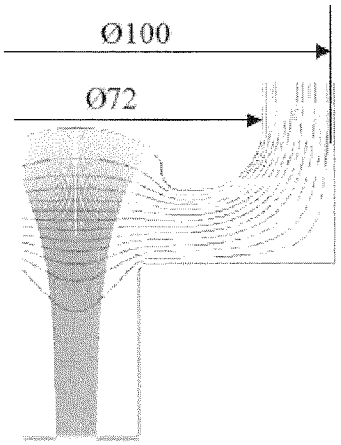
FIGS. 32*a* and 32*b* are exemplary magnetic field diagrams for an RF source.
Figure 32B:
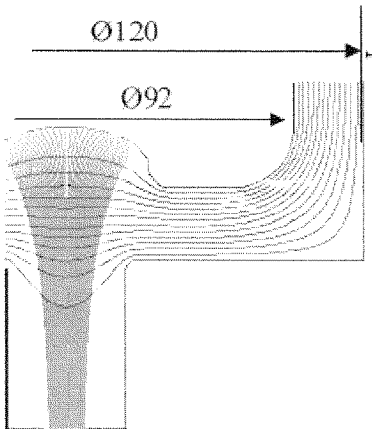

FIGS. 32*a* and 32*b* illustrate the effect on the characteristics of a beam by including a focusing electrode.

Figure 33:
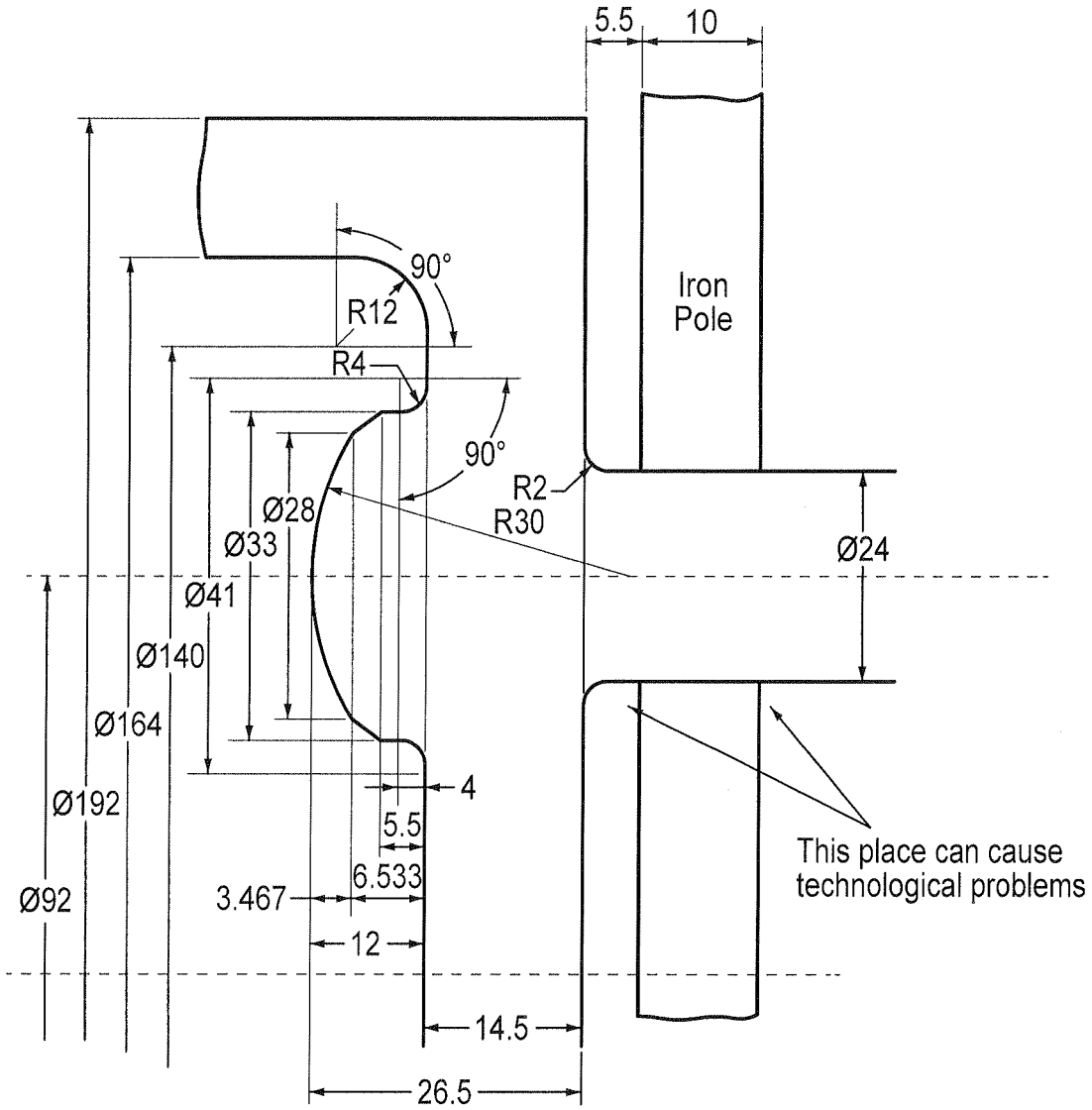
FIG. 33 illustrates exemplary aspects of a cathode for an RF source.

FIG. 33 illustrates exemplary dimensions for the gun configuration.

Figure 34A:
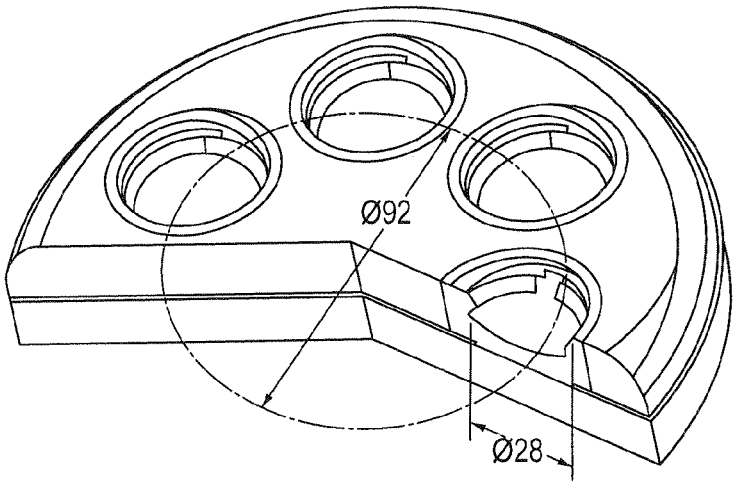
FIGS. 34*a* and 34*b* are exemplary cathodes for an RF source.
Figure 34B:
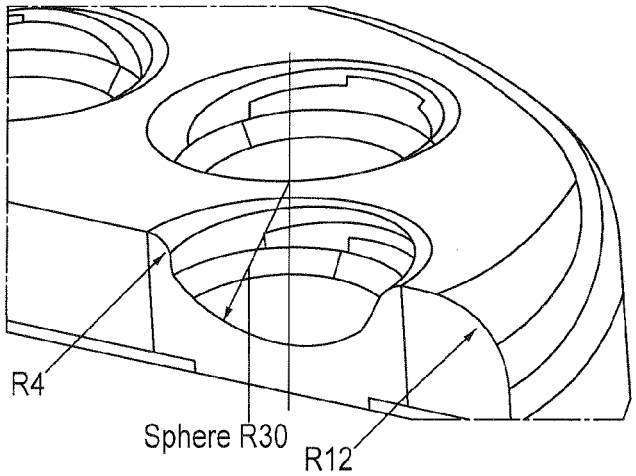
Figure 35:
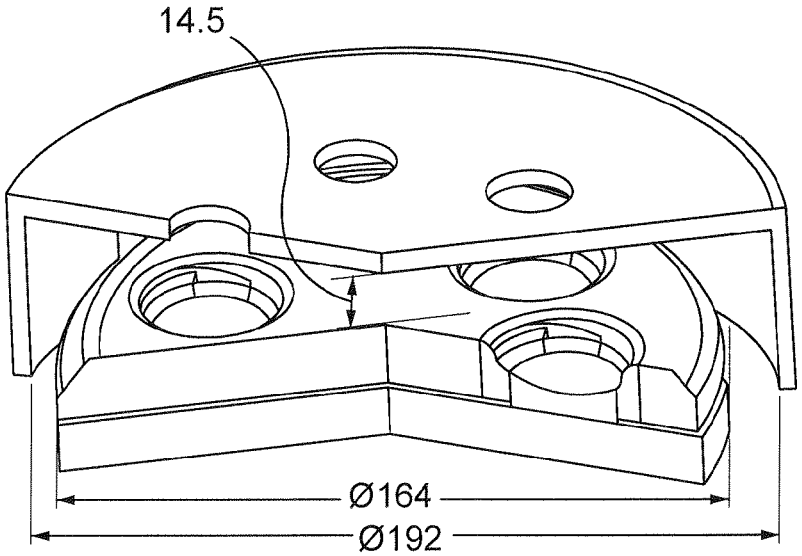
FIG. 35 illustrates exemplary aspects of a cathode for an RF source.
Figure 36:
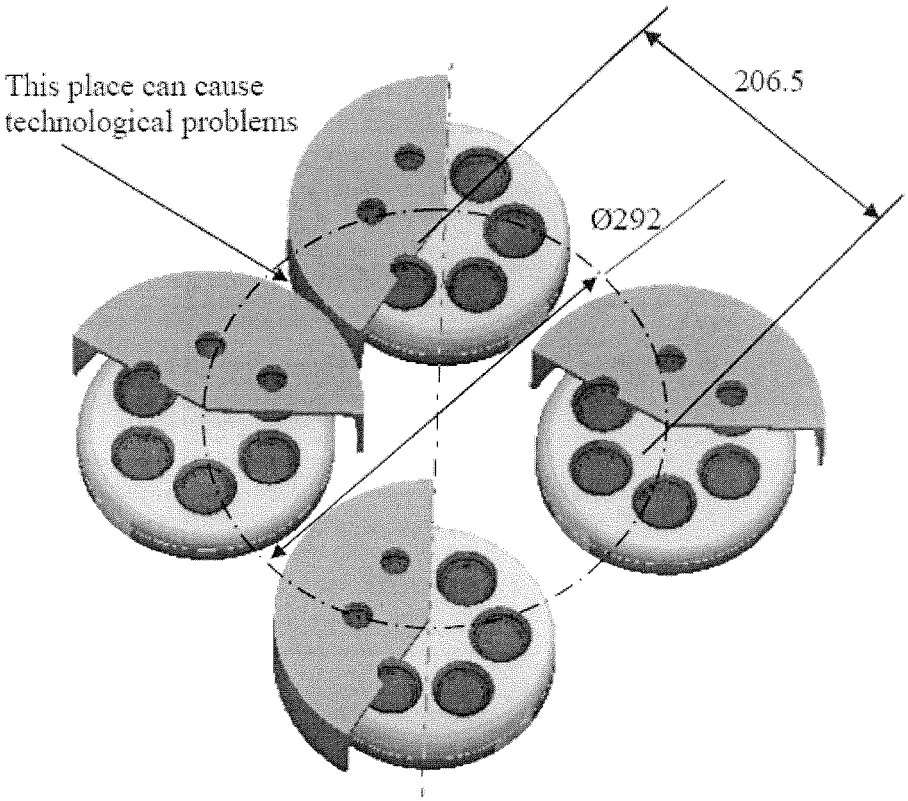
FIG. 36 illustrates aspects of an exemplary configuration of a 10 MW Klystron cathode.

FIG. 34*a* and 34*b* illustrate a view of a cluster cathode having a cut-away portion. FIG. 35 illustrates a cathode and anode having a cut-away portion. FIG. 36 illustrates the cluster cathodes in a 10-MW Klystron, positioned relative to each other.

Beam Collector

Aspects may further include a beam collector capable of operating with a beam having a peak power of up to 3 MW and an average power of up to 75 kW. The volume of a collector should support parasitic oscillations, as well as to reflect by a space charge electric field of the beam a part of delayed electrons. Therefore the collector for this tube may be divided into four electrically independent parts in order to reduce space charge effects. Simultaneously, while maintaining acceptable thermal loading on the collectors, this enables a reduction in their length. Further reduction in collector size can result from use of 24 independent micro-collectors, one for each beam-let.

A reduction of a voltage of the fourth cavity by it detuning on 100 MHz concerning operating frequency results in reduction of energy spread in a beam and to disappearance of reflections. However, the efficiency decreases from 66.6% to 65.3%.

The impact of a beam on a cone of an output is not dramatic. It is a natural process in a cooled collector. Here the density of Power can be rather insignificant.

Figure 37:
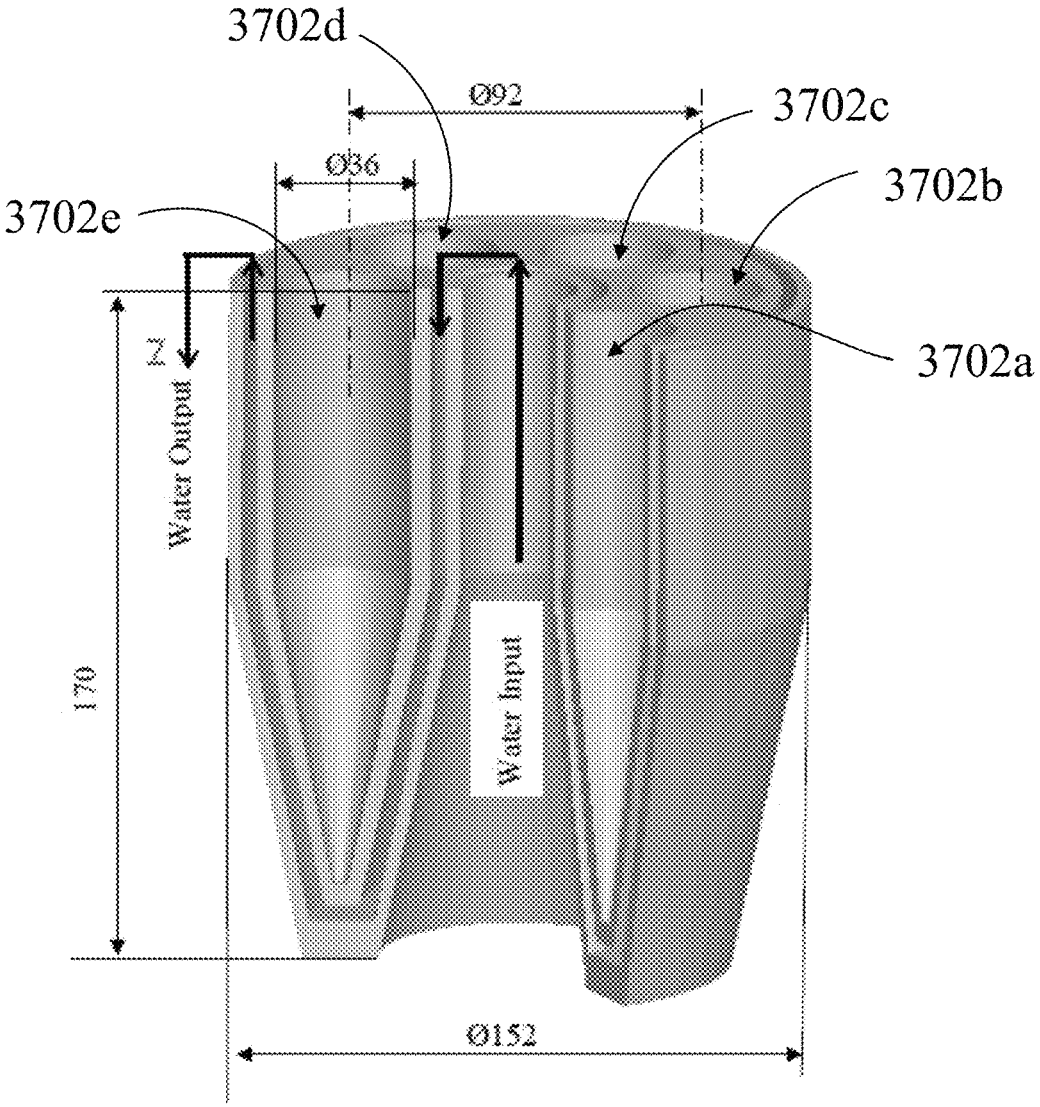
FIG. 37 illustrates an exemplary collector having six holes, e.g., 3702*a*, 3702*b*, 3702*c*, 3702*d*, and 3702*e*. The performance of this six hole cluster collector is shown in Table 17.

FIG. 37 illustrates an exemplary collector having six holes. The performance of this six hole cluster collector is shown in Table 17.

TABLE 17

| Performance of the Cluster Collector with Six Holes | | |
|---|---|---|
| Number of Holes | 6 | |
| Pulse Duration | 1.5 | mc |
| Repetition Rate | 10 | Hz |
| Average Thermal Power (Modulated Beam, 50% Efficiency) | 32 | kW |

TABLE 17-continued

| Performance of the Cluster Collector with Six Holes | | |
|---|---|---|
| Maximum of Average Power Density | 60 | W/cm$^2$ |
| Maximum of Pulse Power Density | 4000 | W/cm$^2$ |
| Total Average Thermal Power (4 Cluster Collector in one Device) Unmodulated Beam | 130 | kW |
| Short-term (1.5 mc) Thermal Power (Emergency Case) | 65 | kW |
| Maximum of Average Power Density | 250 | W/cm$^2$ |
| Maximum of Pulse Power Density | 16000 | W/cm$^2$ |

A collector for a six beamlet cluster may also be configured with a common hole. In this implementation, six beams are replaced with a ring beam. The width of a ring is equal to diameter of a beam-let. The current of a ring beam is equal to a current of six beam-lets. $I_{BEAM}$=6.12 A. A voltage of a beam is equally to: $V_{BEAN}$=(1−Efficiency)·60 kV. The divergence angle of a beam is equal to a divergence angle of a beam-let. The performance of this collector having a common hole is shown in Table 18.

TABLE 18

| Performance of the Cluster Collector with a Common Hole | | |
|---|---|---|
| Beam Current | 72 | A |
| Pulse Duration | 1.5 | mc |
| Repetition Rate | 10 | Hz |
| Average Thermal Power (Modulated Beam, 50% Efficiency) | 32 | kW |
| Maximum of Average Power Density (Average Collector Loading) | 25 | W/cm$^2$ |
| Maximum of Pulse Power Density Modulated Beam (Pulse Collector Loading) | 1600 | W/cm$^2$ |
| Total Average Thermal Power (4 Cluster Collector in one Device) Unmodulated Beam | 130 | kW |
| Short-term (1.5 mc) Thermal Power (Emergency Case) | 65 | kW |
| Maximum of Average Power Density | 180 | W/cm$^2$ |
| Maximum of Pulse Power Density | 12000 | W/cm$^2$ |

Average power density (loading) of a collector up to 100 W/cm$^2$ can be considered as acceptable. And, in the same way, the value of 5000 W/cm$^2$ can be considered as acceptable for pulse power density (1.5 mc, 10 Hz) for a long operating time.

Disappearance of modulation of a beam is necessary to considering as an emergency case (loading is about 250 W/cm$^2$) and to switch off the power supply prior to the beginning of the next pulse of a current (100 mc).

A collector with the common hole has much smaller loading (25 W/cm$^2$) in comparison, with a collector having six holes (60 W/cm$^2$). It possesses the greater surface and is loaded in regular more intervals. Lengthening of a collector more than 350 mm does not result in the further reduction of loading. The highest loading is in its initial part.

When there is a high change of a voltage of a beam, the part of the modulated beam with a voltage of less than 10-12 kilovolt can be reflected in the drift tube. Danger of self-excitation of a beam in a collector can also be high. Thus, for a design of a collector that provides heat rejection with power density of 60 Watt per cm$^2$, the collector with six holes may be preferable.

Table 19 describes an exemplary tuning for the cavities.

TABLE 19

| Exemplary Cavity Tuning | | | | | | |
|---|---|---|---|---|---|---|
| Cavity Number | Input | 2$^{nd}$ | 3d SHC | 4$^{th}$ | 5$^{th}$ | Output |
| HFSS file | IC.pjt | GC.pjt | SHC.pjt | PC1.pjt | PC2.pjt | PC.pjt |
| Resonance Frequency (MHz) | 1300 | 1302 | 2588 | 1409 | 1348 | 1300 |
| Circuit Quality | 400 (300) | | | | | 47 |

Various aspects or features will be presented in terms of systems that may include a number of devices, components, modules, and the like. It is to be understood and appreciated that the various systems may include additional devices, components, modules, etc. and/or may not include all of the devices, components, modules etc. discussed in connection with the figures. A combination of these approaches may also be used.

While the foregoing disclosure discusses illustrative aspects and/or embodiments, it should be noted that various changes and modifications could be made herein without departing from the scope of the described aspects and/or embodiments as defined by the appended claims. Furthermore, although elements of the described aspects and/or embodiments may be described or claimed in the singular, the plural is contemplated unless limitation to the singular is explicitly stated. Additionally, all or a portion of any aspect and/or embodiment may be utilized with all or a portion of any other aspect and/or embodiment, unless stated otherwise.

While this invention has been described in conjunction with the exemplary implementations outlined above, various alternatives, modifications, variations, improvements, and/or substantial equivalents, whether known or that are or may be presently unforeseen, may become apparent to those having at least ordinary skill in the art. Accordingly, the exemplary implementations of the invention, as set forth above, are intended to be illustrative, not limiting. Various changes may be made without departing from the spirit and scope of the invention. Therefore, the invention is intended to embrace all known or later-developed alternatives, modifications, variations, improvements, and/or substantial equivalents.

What is claimed is:

1. A low-voltage, multi-beam, radio frequency (RF) source comprising:

a plurality of electron guns, each electron gun including a plurality of cathodes, each cathode emitting an individual electron beam such that each electron gun emits a plurality of electron beams, wherein axes of the plurality of cathodes for each electron gun are located at regular intervals on a first circle surrounding an axis of the corresponding electron gun such that the plurality of individual electron beams are emitted at regular intervals on the first circle surrounding the axis of the corresponding electron gun, and wherein axes of the electron guns are located at regular intervals on a second circle surrounding a central axis of the RF source.

2. The RF source according to claim 1, further comprising:

an input cavity;

an output cavity; and a series of gain cavities corresponding to each of the electron guns, the series of gain cavities being disposed between the input cavity and the output cavity, wherein the input cavity and the output cavity are common to all of the plurality of emitted electron beams of the RF source and the series of gain cavities are common only to the plurality of electron beams generated by each electron gun.

3. The RF source according to claim 2, wherein the number of the series of gain cavities is equal to the number of electron guns, each of the series of gain cavities being located at regular intervals on the second circle surrounding the central axis of the RF source, and wherein the axis of each of the series of gain cavities coincides with the axis of its corresponding electron gun.

4. The RF source according to claim 3, wherein the input cavity and the output cavity are configured as a torus having a plurality of cylindrical metal shunts equal to the number of electron guns, each metal shunt having electric contact to both faces of the torus and being positioned at regular intervals on a third circle around an axis of the torus, wherein the axis of each of the metal shunts coincides with the axis of one of the electron guns, and wherein an opening for each of the plurality of electron beams generated by one electron gun is provided around the axis of each metal shunt, the openings being positioned at regular intervals.

5. The RF source according to claim 3, further comprising:

a plurality of multi-hole beam collectors, one corresponding to each of the electron guns, each multi-hole beam collector having a plurality of electron beam absorbing openings, wherein axes of the beam-let absorbing openings are positioned at regular intervals on a circle surrounding an axis of the multi-hole beam collector, and wherein axes of the multi-hole beam collectors are positioned at regular intervals on a circle around the central axis of the RF source.

* * * * *